US009915275B2

(12) United States Patent
Patterson

(10) Patent No.: US 9,915,275 B2
(45) Date of Patent: Mar. 13, 2018

(54) STACKED SHUTTLE VALVE

(71) Applicant: Proserv Operations, Inc., Houston, TX (US)

(72) Inventor: Andy Patterson, Katy, TX (US)

(73) Assignee: PROSERV OPERATIONS, INC., Houston, TX (US)

( * ) Notice: Subject to any disclaimer, the term of this patent is extended or adjusted under 35 U.S.C. 154(b) by 214 days.

(21) Appl. No.: 14/743,813

(22) Filed: Jun. 18, 2015

(65) Prior Publication Data

US 2015/0369002 A1 Dec. 24, 2015

Related U.S. Application Data

(60) Provisional application No. 62/082,487, filed on Nov. 20, 2014, provisional application No. 62/014,472, filed on Jun. 19, 2014.

(51) Int. Cl.
*F15B 13/02* (2006.01)
*F15B 13/00* (2006.01)

(52) U.S. Cl.
CPC ..... *F15B 13/028* (2013.01); *F15B 2013/002* (2013.01)

(58) Field of Classification Search
CPC ..... F15B 13/028; F15B 2013/002; Y10T 137/2564; Y10T 137/2567; Y10T 137/2569; Y10T 137/5109; Y10T 137/87925
USPC ..... 137/111, 112, 113, 269, 614
See application file for complete search history.

(56) References Cited

U.S. PATENT DOCUMENTS

| | | | | |
|---|---|---|---|---|
| 6,257,268 | B1 | 7/2001 | Hope et al. | |
| 6,318,400 | B1 | 11/2001 | Hope et al. | |
| 7,159,605 | B2 | 1/2007 | Thrash, Jr. et al. | |
| 2013/0032222 | A1* | 2/2013 | Bresnahan | F15B 13/028 137/112 |
| 2013/0037736 | A1* | 2/2013 | Bresnahan | F16K 11/044 251/279 |

* cited by examiner

*Primary Examiner* — Eric Keasel
(74) *Attorney, Agent, or Firm* — Patterson & Sheridan, L.L.P.

(57) ABSTRACT

The present invention generally relates to a stacked shuttle valve. More specifically, the present invention relates to a stacked shuttle valve that is; fully reconfigurable in the field, facilitated by adding or removing stages, allowing the total number of stages in an existing shuttle stack to be varied in order to suit the application requirement; fully serviceable in the field, facilitated by the installation of new shuttle and seat components shuttle components, without requiring the full dismantling of the shuttle stack and body replacement; spring biased at each stage within the stack by utilizing a small conical coil shuttle spring; leak tight shuttle without the need to coin the metal to metal adapter seal by utilizing a radius shaped shuttle seat; uses shuttle and seat components that are interchangeable with the single shuttle assembly; and capable of greater flow rates.

17 Claims, 16 Drawing Sheets

STACKED SHUTTLE VALVE

CROSS-REFERENCE TO RELATED APPLICATIONS

This application claims benefit of United States provisional patent application Ser. No. 62/082,487, filed Nov. 20, 2014 and United States provisional patent application Ser. No. 62/014,472, filed Jun. 19, 2014. Each of the aforementioned related patent applications is herein incorporated by reference.

BACKGROUND OF THE INVENTION

Field of the Invention

Embodiments of the present invention generally relate to shuttle valves.

Description of the Related Art

In hydrocarbon exploration and production, blowout preventers (BOPS) are used to seal a fluid path in the event of an emergency, such as an overpressure condition in the well bore which could, if not controlled, lead to a discharge of well fluids or a "blowout" condition. Blowout preventers typically use opposed hydraulically powered rams to contact and close a drill or production pipe in a blowout event. Each ram is a fluid filled cylinder with a piston face on one side thereof and a rod on the other side. When the rams are actuated, fluid on the piston side thereof is pressurized and the rod (ram) is driven out of the cylinder and into contact with the pipe. Reverse operation causes the rams to retract. The rams can be shaped so that the rod portions coming from either side of the pipe have a cutout conforming to the pipe, can be flat to be used when no pipe is present, or have knife like cutting surfaces to cut through the pipe and close off the well bore.

Fluid power circuits for actuating the rams are necessarily redundant and spring biased shuttle valves are effective for ensuring an alternative fluid path through the valve to the hydraulically operated device, such as the blowout preventer. In most instances, the valves are "stacked" to provide a plurality of redundant fluid pressure sources to the BOP, and thus provide redundancy in case of a failure of a particular valve or its pressurized fluid source.

Current stacked shuttle valve designs are not easily reconfigurable and must be:

1) wholly replaced when a shuttle stage needs to be added or removed, or 2) wholly dismantled when an individual shuttle or component related thereto needs to be added or removed.

fully dismantled prior to the servicing thereof in the field.

processed to include coined seal elements after assembly in order to achieve a leak tight metal to metal adapter seal.

configured with a large spring biased shuttle valve adapter assembly in order to provide the spring bias functionality.

Additionally, the components of current stacked shuttle valves cannot be used in single shuttle valve assemblies.

Due to the increased depth of BOP installations in current subsea drilling operations, and changes in regulatory requirements which can require re-configuration of stacked shuttle valves and increased flow rates, prior art shuttle valve stacks no longer meet expected long term industry requirements.

There is a need in the industry for a shuttle valve stack arrangement that is designed to be fully serviced and reconfigurable in the field. This is a further need to significantly reduce stacked shuttle valve down time for repair, improve reliability of stacked shuttle valves and enable an end user to reconfigure stacked shuttle valves when required without the need to return them to the manufacturer.

There is a further need in the industry for a re-configurable pressure and spring biased shuttle valve that has the flow rate capacity needed for normal BOP ram operation and the specific BOP ram stroking, i.e., "closing", time limit required by industry and regulations.

SUMMARY OF THE INVENTION

The present invention provides a stacked shuttle valve wherein two or more valves forming the stacked shuttle use the same, interchangeable, body. The body includes a first inlet, a second inlet, and an outlet selectively communicable between one of the first and second inlets. A cross bore extends through the valve body, which is intersected by the first inlet and the outlet. An inlet adaptor is provided in the second inlet which terminates one end of the crossbore, which is configured to receive a high pressure piping therein. At the opposed end of the crossbore, a cap member extends over the end of the crossbore to seal off the cross bore. Both the cap and the inlet adaptor include an inwardly extending sleeve portion, the end of which includes a tapered inner face at the end thereof. A shuttle is supported in the hollow sleeve portions, and the shuttle also includes opposed curved sealing surfaces engage against, and seal to, the tapered surfaces of the sleeve when pressed against either one of them to seal off the first or second inlet. The cap and the inlet adaptor are also removable, in order to allow the internal components of the valve to be removed, replaced, serviced or reconfigured without the need to fully disassemble the valve. Thus, the stacked shuttle valve is:

1) fully re-configurable in the field, facilitated at least in part by adding or removing stages, allowing the total number of stages in an existing shuttle stack to be varied in order to suit the application requirement, 2) fully serviceable in the field, facilitated at least in part by the capability to install new shuttle and seat components without requiring the full dismantling of the shuttle stack and/or body replacement, 3) spring biased at each shuttle valve stage within the shuttle valve stack by use of a small conical coil shuttle spring, 4) leak tight without the need to coin the metal to metal adapter seal by utilizing a radius shaped shuttle seat, 5) configured for reduced parts inventory and greater interchangeability by use of shuttle and seat components that are interchangeable with a single shuttle assembly, including a Full Flow Pressure Biased Shuttle Valve adapter assembly, which allows a remotely operated vehicle to connect thereto and operate a blowout preventer at full rated flow and pressure.

6) capable of greater flow rates.

The embodiments herein significantly improve the flow performance, shuttle seal performance, field serviceability and manufacturability of present stacked shuttle valves.

In another embodiment, a re-configurable pressure and spring biased shuttle valve is disclosed having a threadable second seat with a coil spring housing. The pressure and spring biased shuttle valve replaces an inlet adaptor in the body of the valve providing the outlet from the stacked shuttle valve. In the pressure and spring biased shuttle valve, a first coil spring produces a force that acts on the piston to maintain the piston in a closed position at the second inlet thereof during normal operation, until ROV intervention is required where an remotely operated vehicle connect to an exterior inlet of the pressure and spring biased shuttle valve.

A second coil spring force is added to the first coil spring force to produce a total combined force that acts on the shuttle via two threaded joints provided in the shuttle. One threaded joint connects the spring rod to the shuttle and the second threaded joint connects the a sprung pin connected to a piston in the cap, to the shuttle. The combined force maintains the closed shuttle position at the second inlet during normal operation until ROV intervention is required. Due to the combined spring force developed by the two coil springs the spring force produced by the first spring is reduced. Reduction of the first coil spring force results in a lower piston opening pressure, otherwise known as cracking pressure in the industry. This reduction in the piston opening pressure results is a smaller pressure drop across the re-configurable pressure and spring biased shuttle valve which is highly desirable when operating the BOP closing ram during ROV intervention.

The first coil spring force and spring rate is reduced to reduce piston dynamic loads, while the total combined spring forces and rates of the first and second coil springs provide the necessary seat force to accomplish the shuttle to ROV adapter metal seal required for the ingress protection needed at installed subsea depths. To achieve reliable operation in an operating condition with a significantly increased flow rate requirements, the pressure and spring biased shuttle valve:

1) significantly increases the effective cross sectional area of the annular flow passage, formed by:

A) reducing the diameter of the piston rod at the threaded connection with the shuttle to increase flow area B) increasing the diameter of the through holes in the radially spaced hole pattern of the shuttle to increase flow area C) reducing the diameter of the piston rod adjacent to the piston rod head to increase flow area 2) guides the piston within the body of the valve utilizing a resilient wear band, or bushing, and two piston o-ring backup rings, in order to:

A) reduce dynamic friction

B) eliminate metal to metal contact between the piston and the I.D. of the body of the valve C) maintain the required alignment of the piston and create the required metal to metal seal.

3) the threaded connection between the piston rod flange and shuttle utilizes two locating diameters and an o-ring seal increasing the ability of the spring rod head to self-center within the piston and create the required metal to metal piston seal 4) the metal seat geometry of the shuttle is formed by a radius which then contacts a chamfered edge of a housing, thus increasing the ability of the seat to self-center and create the required metal to metal seal.

In a further embodiment, the stacked shuttle valve is configured such that if all fluid is directed to all inlets, the shuttle controlling the opening of the first inlet to which the flow reaches will allow flow therethrough to the outlet, and block and flow coming from an upstream valve in the stacked shuttle valve. In this embodiment, the flow passages on one side of the shuttle provide passages for fluid to enter and exit the shuttle from a first inlet of the individual valve of the stacked shuttle valve. If the second inlet thereof is the first to receive fluid flow, the shuttle will move such that the openings on the one side of the shuttle are positioned to either side of the first inlet, with an intervening seal therebetween, thereby sealing off the first inlet from the outlet.

DETAILED DESCRIPTION

The assignee of the present invention has been producing shuttle valves for use in the subsea production of oil and gas for a number of years. For example, see U.S. Pat. No. 7,159,605 (hereinafter '605 patent) and U.S. Pat. No. 6,257, 268 (hereinafter '268 patent). Each of these patents is incorporated herein in its entirety.

Figure 1:
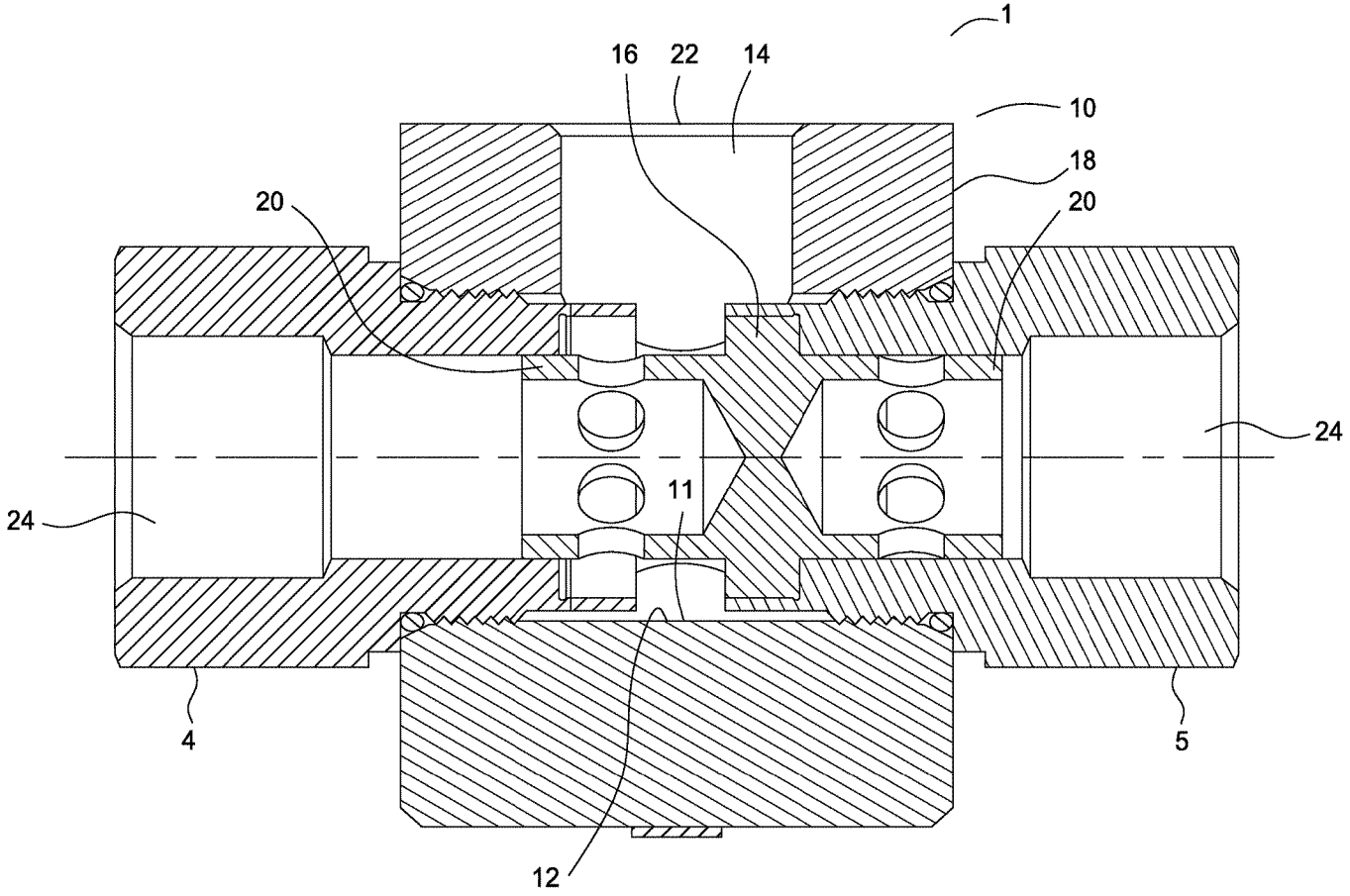
FIG. 1 is a sectional view of a prior art shuttle valve.

In a shuttle valve 1 of FIG. 1 such as that shown in U.S. Pat. No. 7,159,605, a generally annular body 10 of the valve is configured with a central passage 12 and a cross flow passage 14. At either end of the central passage 12, threaded adaptors 4, 5 are sealingly threaded thereinto, to hold a shuttle 16 therebetween. The shuttle 16 includes a central sealing wall 18, and perforated flow guides 20 extending from either side thereof. The shuttle sealing wall 18 sealingly engages against one of the two adaptors, being biased into position by pressure. For example, when the pressure at an inlet 24 through adaptor 4 is greater than that at the inlet 24 for adaptor 5, the shuttle is biased against adaptor 5, and fluid communicates from the inlet 24 through adaptor 4 and into the cross bore 14 and thus the outlet 22 of the valve 10. If the pressures are reversed, the shuttle 16 moves in the space between the two adaptors to seal against adaptor 4, thus communicating the fluid and pressure at the inlet 24 to adaptor 5 with the cross bore 14 and thus the valve outlet 22.

The shuttle valve 1 components are subject to wear, and on occasion cracking or chipping and need to be periodically replaced, or undergo scheduled repair and replacement based on an expected useful lifetime thereof. Additionally, for safety reasons, redundancy in the fluid control systems used to control blowout preventer operation is now mandated and higher valve pressure requirements are expected in the future. To address the need for redundancy, a stacked shuttle valve may be used, wherein one of several fluid inputs in excess of two can be individually directed to the shuttle valve outlet. However, current designs of stacked shuttle valves are formed in a single body, are heavy and cumbersome, have unique components and cannot be easily repaired or reconfigured in the field.

In the embodiments described herein, a shuttle body 98, having at least two flat sides through which at least an inlet and an outlet are separately formed, is used as the body, and thus the basic building block, of each stacked shuttle valve described herein. Preferably, but not essential, the body 98 has a generally rectangular box form having six sides, each side orthogonal to the adjacent four sides thereto. Each side is generally flat, such that a flat surface to a flat surface contact can be effectuated between adjacent bodies 98, and the overall size of the stacked shuttle valve formed therewith be reduced. By using the same body 98 for each valve of the stacked shuttle valve, the body forms a basic building block for a stacked shuttle valve, and the valve, once manufactured, can be readily modified by adding or taking away additional valves. The interior parts of the body are easily accessed, and thus the internal components thereof can be accessed for service or replacement without disassembly of the stacked shuttle valve.

Figure 2:
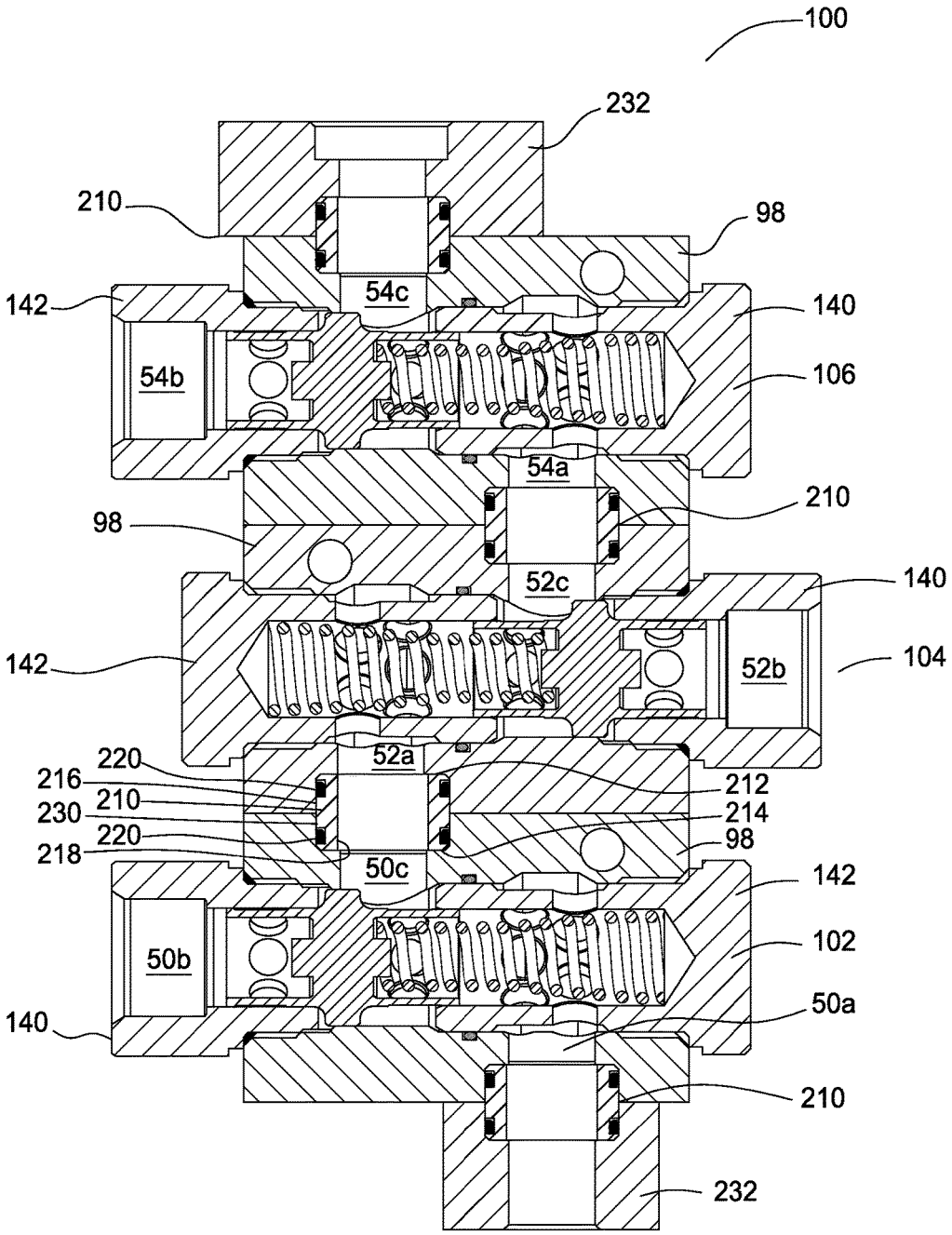
FIG. 2 is a sectional view of a stacked shuttle valve including a plurality of shuttle valves having the same construct interconnected between an inlet and outlet thereof, showing the first inlet of the lowermost valve in the open position and the second inlet of the lowermost valve in the closed position.

FIG. 2 shows a cross-sectional view of a re-configurable stacked shuttle valve 100, in this example configured with three stages i.e., three individual stackable shuttle valves 102, 104, 106 providing a total of four different inlets, inlets 50*a*, and 52*b, c* and *d*, and outlet 54*c*. Each individual shuttle valve 102, 104 and 106 is configured to be interchangeable in the stack of shuttle valves comprising the stacked shuttle valve. Using shuttle valve 102 as an exemplar, each shuttle valve includes a body 98 having a first inlet 50, a second inlet 52, and an outlet 54. To form a stacked shuttle valve, as shown in FIG. 2, the outlet 54*a* of a first valve, for example shuttle valve 102, is connected to the first inlet 50*b* of the second shuttle valve 104. This connection paradigm is repeated to connect the outlet 54*c* of the shuttle valve 104 to the first inlet 50*a* of the shuttle valve 106. A further plurality of shuttle valves can be so connected limited only by the pressure drop occurring over a long series of valves. Each valve is configured, in the position of the shuttles thereof shown in FIG. 2, to communicated fluid and pressure between the first inlet 50 and the outlet 54 thereof, and as a result, the fluid at the first inlet 50*a* of shuttle valve 102 is communicated to the outlet 54*c* of shuttle valve 106.

In the configuration of the stacked shuttle valve 100 of FIG. 2, the inlets 52*b* of the three shuttle valves 102, 104 and 106 include threaded SAE inlet adapters 142 received therein. In normal operation, inlet 50*a* of the first stackable shuttle valve 102 is pressurized, providing a fluid path through the stacked shuttle valve 100, via the second and third stage shuttle valves 104, 106, and thence to the outlet 54*c* extending from third stage shuttle valve 106. Each stage, and thus each stackable shuttle valve, is of the same configuration. Additionally, each stackable shuttle valve 102 et seq. may be removed from the reconfigurable shuttle stack 100 for service or reconfiguration thereof.

Figure 3:
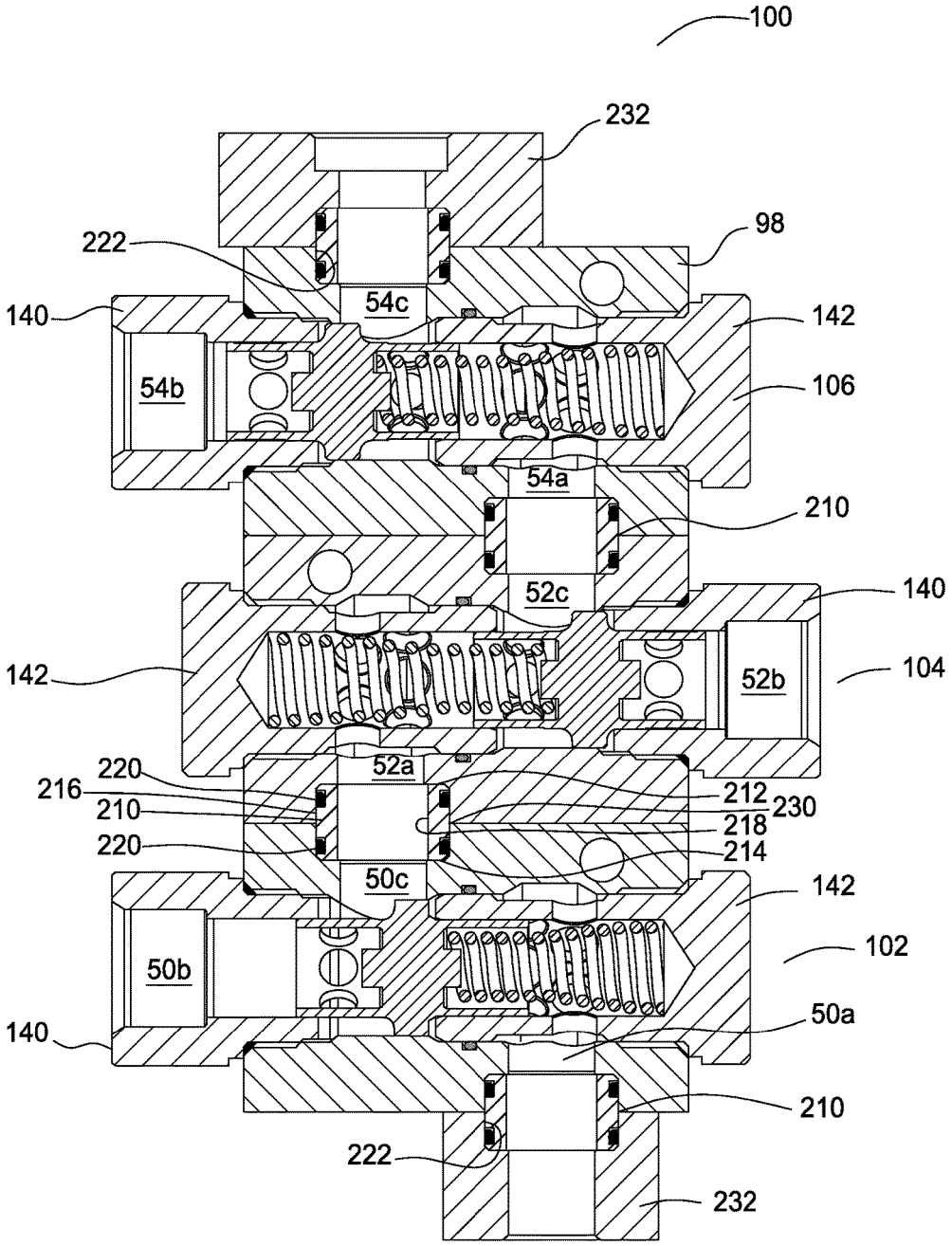
FIG. 3 is a sectional view of a stacked shuttle valve of FIG. 2, showing the second inlet of the lowermost valve in the open position and the first inlet of the lowermost valve in the closed position.

In FIG. 2, the stacked valve assembly 100 is shown with the pressure at inlet 50*a* of shuttle valve 102 communicating through the shuttle valve 102, through shuttle valve 104 and through valve 106 to the outlet 54*c* of shuttle valve 106, which outlet is connected to a further valve, a blowout preventer, or other apparatus. In contrast, in FIG. 3, the shuttle of the first shuttle valve 102 has been moved, as a result of a higher force/pressure on the second inlet 52*a* side thereof, to block the first inlet 50*a* and thus communicate the fluid at inlet 52*a* through the shuttle valves 102, 104 and 106 and to outlet 54*c*.

Figure 4:
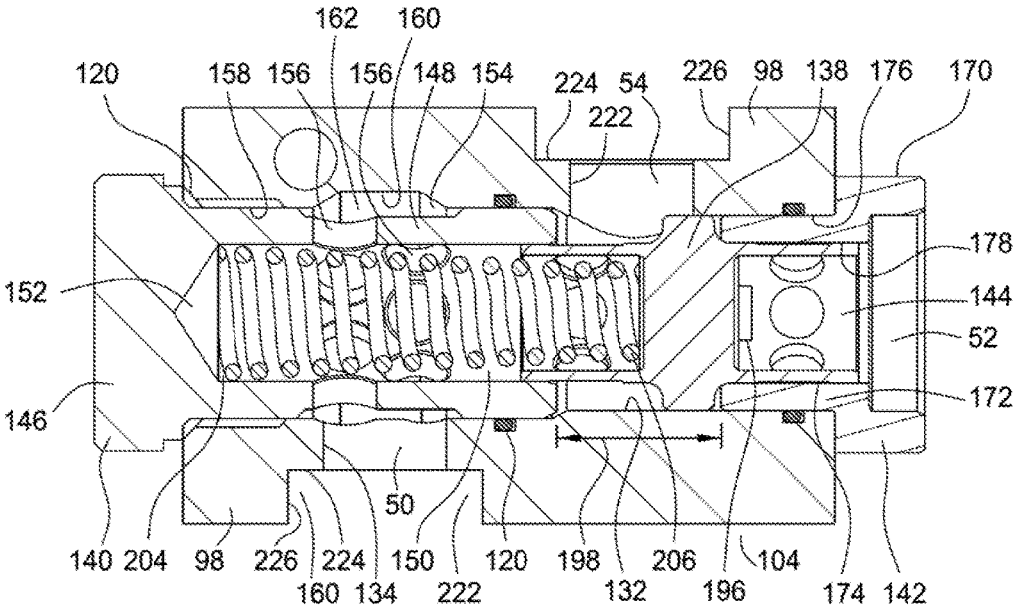
FIG. 4 is a sectional view of a single valve of the stacked shuttle valve of FIG. 2.

Referring to FIG. 4, an individual shuttle valve incorporated in the stacked shuttle valve, such as any of stack valves 102, 104 and 106, is shown in section. Each stackable shuttle valve is configured of a generally rectangular, in cross section, body 98 having a through crossbore 132 extending therethrough, first and second cross bores which intersect the through bore 132 and are configured as an inlet bore 50 and an outlet bore 54, and a shuttle 144 replaceably and reciprocally received within the through crossbore 132. The shuttle valve further includes a counterbored cap 140 which is removably inserted into one end of the crossbore 132 where the crossbore 132 exits one end of the body 130, and a removable threaded inlet adaptor 142 received in threads 176 on the inner surface of the cross bore 132 located at the opposed end of the cross bore 132 from the counterbored cap 140 where the crossbore 132 exits the opposed side of body 130. The counterbored cap 140 and the inlet adaptor 142 retain the shuttle 144 therebetween in the crossbore 132, and also provide the physical stops against which the shuttle 144 is biased and forms a seal during use of the valve.

Counterbored cap 140 includes an enlarged head portion 146, and an annular sleeve body 148 extending integrally therefrom. An o-ring 120 is positioned between the enlarged head portion 146 and the adjacent end of body 98, and a second o-ring 120 is located between the sleeve body 148 and the inner surface of the crossbore 132, such that a seal is formed to either side of the location where the first inlet enters the crossbore 132. An inner portion of the counterbored cap 140 surrounded by the annular sleeve portion 148 forms a counterbore 150, the innermost face of which is configured as a conical recess 152 extending in the direction of the cap 146. The outer surface of the annular sleeve portion 148 includes an outer recess 154 extending inwardly thereof, and a plurality of openings 156 extend through the annular sleeve portion 148 at the recess 152. The openings are staggered in the longitudinal direction of the annular sleeve portion 148 in a zig-zag pattern, enabling an increased opening area through the wall of the annular sleeve portion 154 than would be possible if they were circumferentially aligned in a straight line path.

Figure 7:
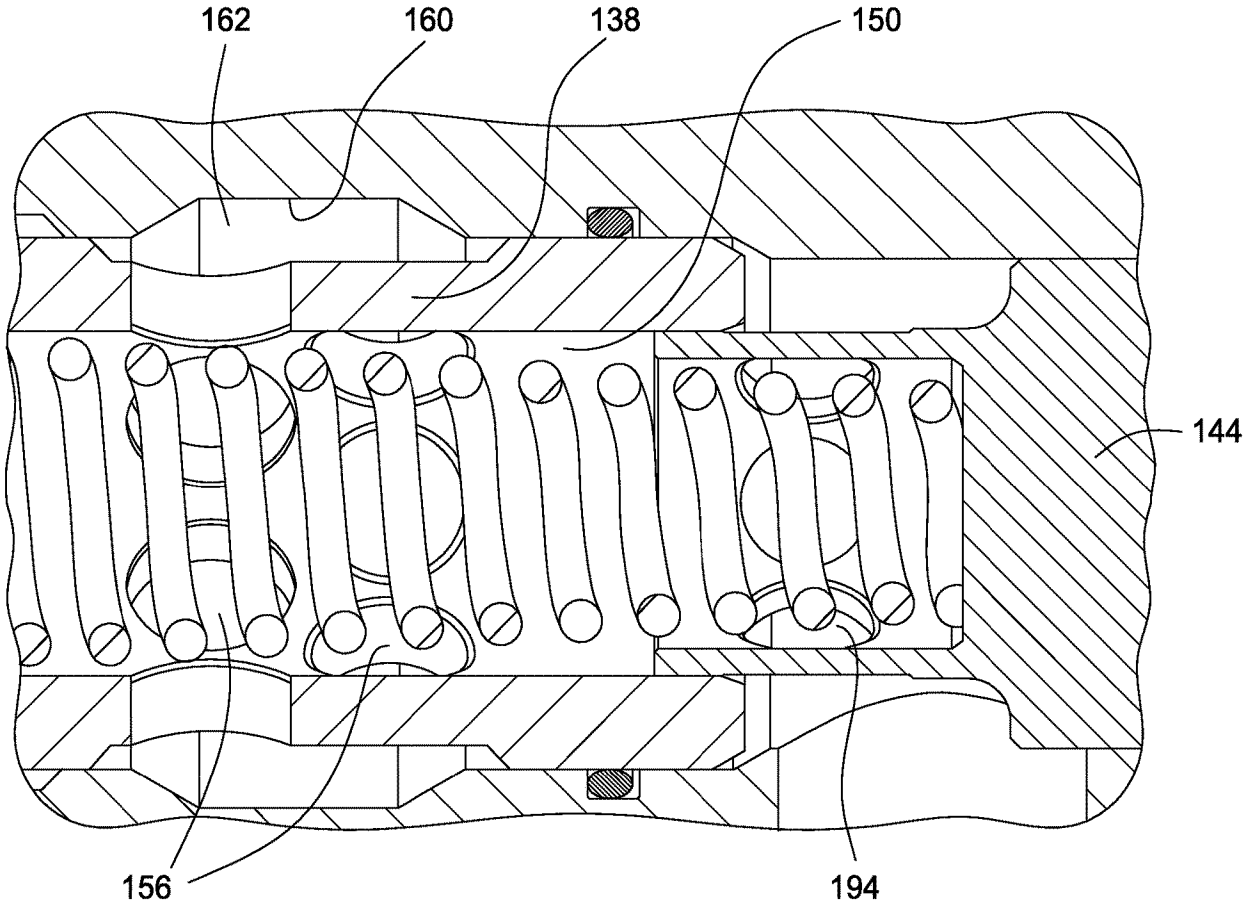
FIG. 7 is an enlarged sectional view of the flow into the cap of the stacked shuttle valve of FIG. 2.

Crossbore 132 includes an inner threaded surface 158 into which threads on the outer surface of counterbored cap 140 are received for connecting the cap 140 to the body 104. To provide the inlet 50, an inlet bore 134 extends from an outer wall of the body 104, and into cross bore 132. Additionally, about the inner circumferential surface of the cross bore 132 a circumferential relief recess 160 extends inwardly of the body 98. As best shown in FIG. 7, the circumferential relief recess 160, along with the outer surface of the recess 154, form an annular flow passage 162 around the annular sleeve portion 138 in the location of the openings 156 therethrough. Thus, a substantially unrestricted flow path is formed from the inlet 50, into the annular flow passage 162, through the holes 156 and into counterbore 150.

Inlet adaptor 142 includes the an outer, major diameter, nipple portion 170 and an inner, minor diameter nipple portion 172 having threads 174 on the exterior thereof, which mate with threads 176 in the cross bore to secure the inlet adaptor 142 in the valve body 104. The inlet adaptor 142 also includes an inner bore 178 extending therethrough. The inner circumference/diameter of the bore 178 has the same inner circumference/diameter as the counterbore 150, within machining tolerances. The bore 178 is enlarged at the opening through the major diameter portion 170 to provide the second inlet 52 to the valve.

Figure 5:
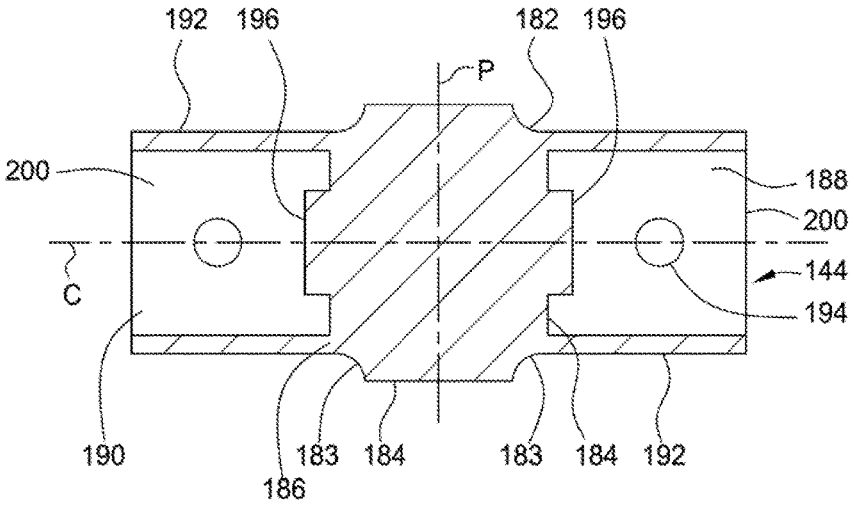
FIG. 5 is a sectional view of the shuttle of the stacked shuttle valve of FIG. 2.

Shuttle 144 is configured to be, at opposed ends thereof, simultaneously received within bore 178 of inlet adaptor 142 and counter bore 150 of cap 140, and is positioned to selectively block fluid flowing from the second inlet 52 of the valve to the outlet 54, or between the first inlet 50 and outlet 54. As shown in FIG. 5, shuttle 144 includes a central annular portion 182 having an outer circumferential wall 184 having nearly the same diameter, and slightly less than the diameter, of through bore 132, which is larger than the outer diameters of the minor diameter nipple portion 172 and the annular sleeve portion 138. Flow guides 188, 190 extend from the opposed sides 184, 186 of the central annular portion 182. Each flow guide 188, 190 is a right annular element having a thin annular wall 192 extending outwardly from the adjacent side 184, 186 of the central annular portion 182, through which flow apertures extend. The annular envelope of annular wall 192 defines a flow bore 200, at the base of which a circular alignment member 196 projects. The shuttle 144 is configured to be reversible, and thus is symmetric about a plane P passing through the center of the central annular portion in a direction generally perpendicular to the centerline C of the cross bore 132, and, about the centerline C. As a result, the shuttle 144 does not need to be specifically oriented when building, repairing or reconfiguring the valves 102, 104 and 106.

Each of the inlet adaptor 142 and the counterbored cap 140 extend inwardly of the respective ends of the cross bore 132 to leave a gap 198 therebetween across the cross bore 132. The gap may be formed by narrowing the cross bore 132 at locations therein to limit the ingress of the inlet adaptor 142 and counterbored cap 140 thereinto, or by the sizing of those components relative to the total length of the cross bore 132. The gap 198 is located to coincide with, and extend to either side of, the location where the outlet 54 intersects the cross bore 132.

Referring to FIG. 4, a partially conical spring 202 is received in each counter bore 150 and extends therefrom into the flow bore 200 of the shuttle which faces the cap 140. The partially conical spring 202 includes a major diameter winding 204 at the end thereof received in, and bearing against, the interface of the recess 152 and the inner wall of the counterbore 150, a minor diameter winding 206 at the opposed end thereof and bearing against the inner wall of the flow bore 200 about the alignment member 196, and a plurality of windings therebetween decreasing in diameter from the major diameter winding 204 to the minor diameter winding 206. The alignment member 196 centers the minor diameter winding 206 end of the partially conical spring 202 in the flow bore 200 of the shuttle 144, and the interface of the recess 152 and the inner wall of the counterbore 150 center the major diameter winding 204 end of the partially conical spring 202 in the counterbore 150. The profile of the partially conical spring is generally in the shape of a major diameter winding portion, a minor diameter winding portion, and a plurality of windings transitioning the spring 202 from the major to minor diameter portions. Alternatively, the spring 202 may be of a uniform diameter, may be continuously reducing in diameter from one end to the other thereof and thus have a truncated cone shape, or the spring constant thereof may be uniform or varied along the length thereof. Additionally, other springs, such as a Belleville spring, may be used. The partially conical spring 202, along with fluid pressure at the inlet 50 of the valve, ensure that the shuttle 144 is seated against the inlet adaptor 142 to seal off flow or fluid pressure communication between inlet 52 and outlet 54. In use, at least one of the inlets 50 and 52 are intended to experience the same, or nearly the same pressure. Thus, the partially conical spring 202 or other spring arrangement adds additional biasing force which will maintain inlet 52 closed if equal pressures are applied to the opposite sides thereof.

Referring again to FIG. 2, the plurality of shuttle valves 102, 104 and 106 are shown in an interconnected state to form the stacked shuttle valve 100. To form a sealing connection between the outlets 54 a and 54*b* of valves 102 and 104 and the corresponding first inlets 50*b*, 50*c* of shuttle valves 104 and 106, a sealing sleeve 210 is provided. Additionally, at the overall inlet 50*a* and outlet 54*c* of the stacked shuttle valve 100, the sealing sleeve 210 is also provided. Sealing sleeve 210 is a generally right, annular tube having opposed ends 212, 214, and outer wall 216 and an inner wall 218, and a pair of seal ring grooves 220, one of each extending inwardly of the outer wall 216 inwardly of an end 212, 214 of the sealing sleeve 210.

The bodies 98 of each shuttle valve 102, 104 and 106 include, at the first inlet 50 and outlet 54 thereof, a counterbore 222 extending therein to form an annular ledge 224 surrounding the inlet 50 or outlet 54, and an annular enlarged counterbored sealing bore 226 extending from the annular ledge 224 to the outer surface of the body 98. The depth of each counterbore, i.e., the spacing between the outer surface of the body 98 and the annular ledge 224 is slightly greater than the height of the sealing sleeve 210 between the first and second ends 212, 214 thereof. Thus, sealing sleeve 210 extends inwardly of the counterbore 222 of an outlet 54 and into the counterbore 222 of the adjacent inlet 50, such that seal rings 230 received in the seal ring grooves 220 extend between the sealing sleeve 210 and the sealing bore 226 to fluidly seal the connection of one shuttle valve in the stacked shuttle valve 100 to the adjacent shuttle valve.

Additionally, at the overall inlet 50*a* and outlet 54*c* of the stacked shuttle valve 100, an adaptor 232 is provided to connect the stacked shuttle valve into a fluid circuit extending between inlet 50*a* and outlet 50*c*. Each adaptor includes a counterbored sealing bore 222 extending inwardly thereof, such that a sealing sleeve 210 is received therein and into the sealing bore 226 of the inlet 50*a* or outlet 54*c* to seal the connection of the valve into the fluid pathway in the same manner as the sealing sleeve 210 seals the outlet 54 of one shuttle valve to the inlet 50 of the next shuttle valve of the stacked shuttle valve 100.

Figure 6:
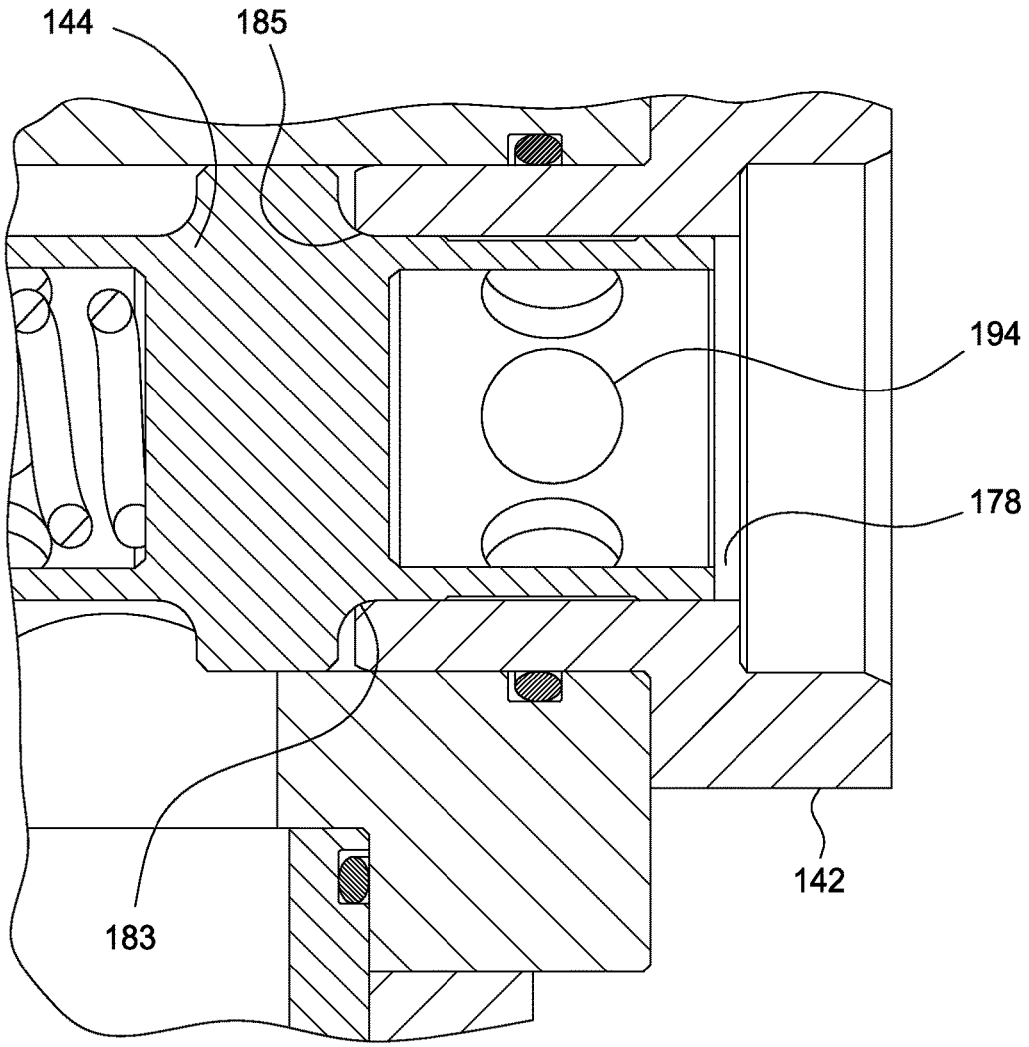
FIG. 6 is an enlarged sectional view of the sealing paradigm for the shuttle of the stacked shuttle valve of FIG. 2.

Referring to FIG. 6, the interface of the flow guide 188 (or 190) of the shuttle 144 with the bore 178 of inlet adaptor 142 (or the counterbore 150 of the cap 140). The interface of the flow guide 188 of the shuttle 144 with the bore 178 of inlet adaptor 142 is illustrated, and the same interface construct is employed between the flow guide 190 of the shuttle 144 and the counterbore 150 of the cap 140. The sliding surface created between the outer surface of the shuttle 144 flow guide 188 (or 190) with the inner surface of the bore 178 of SAE adaptor 170 (or the counterbore 150 of the cap 140) self-centers the shuttle 144 in these elements, which serve as field serviceable seat inserts. The shuttle 144 includes a radiused surface 183 extending from the circumferential wall 184 to the outer surface of the annular wall 192, and the ends of the cap 140 and inlet adaptor 142 include an inner tapered or chamfered surface 185. As the shuttle 144 approaches sealing engagement with one of the cap 140 or the inlet adaptor 142, the radiused surface 183 helps center the shuttle 144 in the cap 140 or inlet adaptor 142 and forms a metal to metal seal therebetween. Thus, the shuttle 144 connection to the tapered inner surface of the bore 178 or counterbore 150 is leak tight without the need to coin surfaces thereof. Coining refers to a cold-working process used to improve surface features. Although the shuttle 144 is described as having a radiused surface 183 and the cap and inlet adaptor have a chamfered or tapered surface 185, these configurations may be reversed, or they may both have complementary radiused surfaces, or they may both have tapered surfaces at different angle relative to the centerlines thereof to effectuate line contact therebetween to form a fluid seal. As a result of these configurations, the shuttle and the inner surface of the bore 178 of SAE adaptor 170 (or the counterbore 150 of the cap 140) do not need to be coined as is done in prior art devices since mating of the metal to metal surfaces of the shuttle valve are self-centering. Elimination of the coining step significantly improves the field serviceability of the stacked shuttle. Additionally, The openings 194 from the flow bores 200 of the flow guides 188, 190 have a radial flow area greater than the flow area of the inlets 50, 52, which ensures the geometry of the shuttle 144 does not restrict flow through the shuttle valve.

Referring to FIG. 7, the plurality of openings 156 and the annular flow passage 162 together provide a flow path into the counterbore 150 of the cap 140 which is less restrictive than the flow path through inlet 50. Additionally, the openings between the spring coils in the fully extended position of the partially conical spring 202 provide a flow path which is greater in area than the flow path at the inlet 50. There are two flow paths in each valve. When shuttle 144 is positioned to seal the opening 50, fluid may flow through inlet 52, through the inner bore of the inlet adaptor 142, and thence through the openings 194 in the shuttle to the outlet 54. When the shuttle 144 is biased against the inlet adaptor 142, inlet 520 is sealed, and flow occurs from inlet 50, through the annular flow passage 162 around the annular sleeve portion 138, through the holes 156 and into counterbore 150. Once in the counterbore 150, fluid flows through the openings 194 in flow guide 190 of the shuttle 144 to outlet 54.

Figure 8:
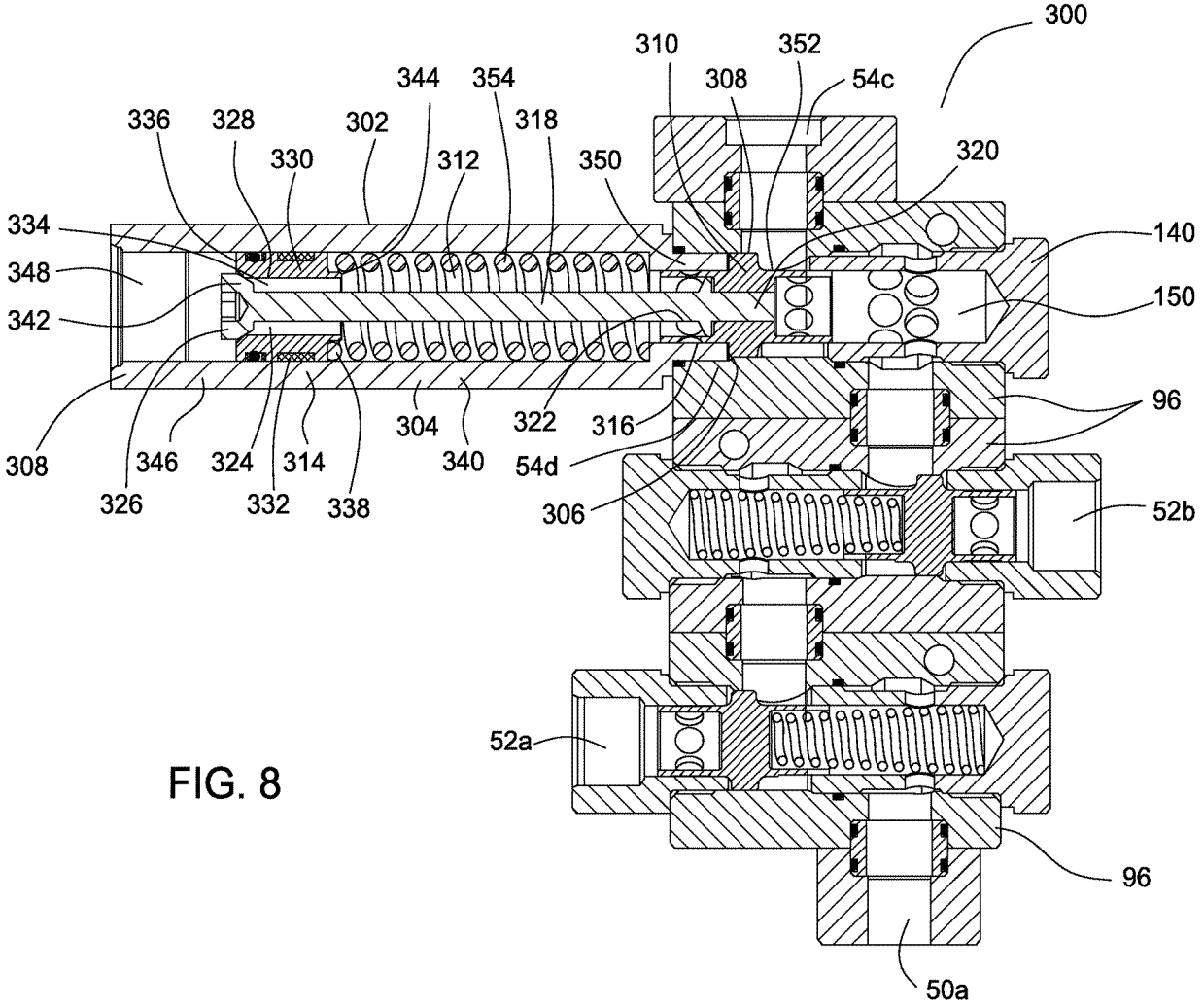
FIG. 8 is an alternative embodiment of a stacked shuttle valve, incorporating a valve operable by a remotely operated vehicle.

Referring now to FIG. 8, an additional embodiment of stacked shuttle valve 300 is shown in cross-section, the embodiment having three valve stages, the third stage incorporating an additional configuration of a valve therein. As in the stacked shuttle valve 100, the stacked shuttle valve 300 includes shuttle valves 102, 104 configured as previously described herein, and a pressure and spring biased valve 302 as the third shuttle valve in the stack, replacing shuttle valve 106 of the stacked shuttle valve 100. The pressure and spring biased valve 302 is configured to be operated by a remotely operated submersible vehicle to connect a pressure source thereon to the inlet 342 of the pressure and spring biased valve 302 to operate the stacked shuttle valve 300 to close a blowout preventer if the valves 102 and 104 do not operate or the pressurized fluid sources thereto fail.

Pressure and spring biased valve 302 is configured using the same body 98 as shuttle valves 102, and 104, and includes a modified shuttle 310 and a dual acting piston 312 in a dual acting piston assembly 314 connected to the second inlet 54*d* thereof. Shuttle 310 is similar to shuttle 144, except projecting member 196 is not present, as no partially conical spring 202 is in used in the cap 140 of shuttle valve 302. Additionally, a shuttle bore 316 extends through the shuttle 310, to slidingly receive, and secure therein, a first end 320 of a center rod 318 of the dual acting piston 312. In other respects, the shuttle 310 has the same features, sizes and function as that of shuttle 144 described previously herein.

Figure 8A:
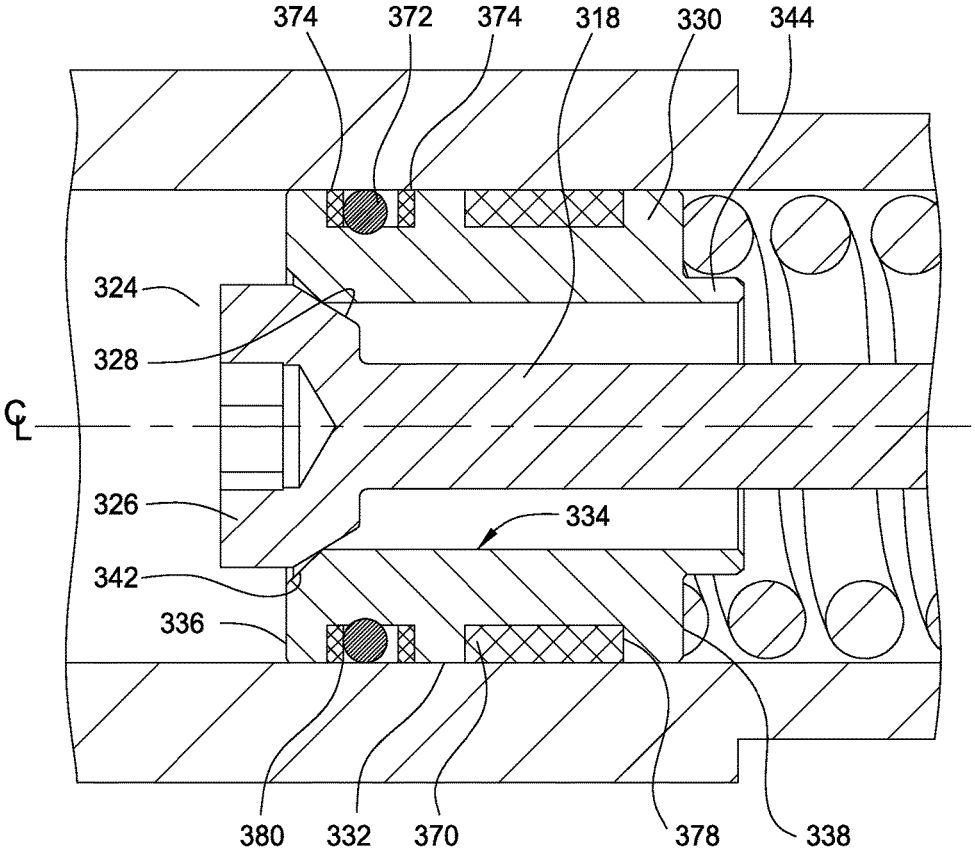
FIG. 8A is an enlarged sectional view of the sealing paradigm of a piston of the valve operable by a remotely operated vehicle.

Dual acting piston 312 includes housing 304 having an open first end forming an inlet 348 to the housing 304 and a threaded reduced diameter portion 306 which is received in second inlet 502*d* of body 98. The inner surface of the reduced diameter portion, at the end thereof, includes the tapered surface to effect sealing with the radiused surface of the shuttle. Within housing 304, a center rod 318 having a first end 320 extends and terminates inwardly of, and secured within, the shuttle bore 316 of the shuttle 310 in the body 98, such as by a threaded connection, the depth of the first end 318 extending into the shuttle limited by flange 322 extending about the outer surface of the rod 320 adjacent first end 329 thereof. As shown in FIG. 8A, the second, opposed, end 324 of the rod 318 includes an enlarged head 326 having a lower, frustroconical surface 328 extending from a sidewall of the head 326 to outer surface of the rod 318. A piston 330 having an outer circumferential wall 332, an inner bore 334 through which rod 38 extends, and an outer face 336 inner face 338 is provided, and received within a housing 340. The piston 330 includes a frustroconical face 342 extending between the inner bore 334 the outer face 336. The angle between the frustroconical surface 328 and the centerline of the rod 318 is less than the angle between the frustroconical face 342 of the piston 330 and the centerline of the rod, with a difference on the order of 15 degrees. As a result, rod head 328 will become centered within the bore of piston 330 against which the frustroconical surface 328 of the enlarged head 326 may selectively bear. The annular inner face 338 includes an alignment ring 344 extending therefrom. Piston 330 is centered within the tube portion 346 of the housing 340 by bushing 370 which is received within a bushing groove 378 extending inwardly of the outer surface of the piston 330. The thickness of the bushing 370 is greater than the depth of the groove 378, such that the outer surface of the bushing contacts the inner surface of the tube portion 346, which spaces the outer surface of the piston 330 from inner surface of the tube portion 346 to prevent metal to metal contact therebetween. To seal the piston 330 to the inner surface of the tube portion 346, a seal groove 380 extends inwardly of the outer wall of the piston 330 adjacent to the grove 378, and back up rings 374 are provided on either side of the seal groove 380, and an o-ring 372 is positioned between the back-up rings within the seal ring groove 380. Housing 340 includes an inner generally right cylindrical surface having an extended tube portion 346, a tube inlet 348 at one end thereof and a threaded nipple 350 at the second end thereof. Threaded nipple 350 is secured in threads in second inlet 54*d*. At the second end of the tube 348, a reduced inner diameter portion 352 is provided, which is configured to sealingly, and slidingly, support flow guide 190 therein. Reduced diameter inner portion 352 includes the same inner tapered surface 185 as that of the inlet adaptor, and thus the radiused surface 183 of the shuttle will be centered in, and form a circumferential line contact seal, with the end of the nipple 320.

In FIG. 8, valve 302 is shown with second inlet 54*d* closed, and inlet 54*a* is in fluid communication with outlet 54*d*. In use, inlet 348 is exposed to the ambient subsea environment. If pressure in the inlet 348 acting against the enlarged head 326 and the first end 336 of the piston 330 provides force in excess of the pressure acting against the shuttle 310 and the first end 320 of the rod 318, and the force of the spring 354 against the piston 330, the shuttle will move from the position thereof in FIG. 8 in the direction of the inlet 50*d*. If the pressure imbalance continues, the shuttle will move to seal off the inlet 54*d* from communication with outlet 54*d*. If yet greater pressure is applied to inlet 348, the piston 330 will move in the direction of the body 98, but, because the shuttle 310 cannot move as it is engaged against the inlet adaptor 142, the rod 318 cannot move further inwardly of the body 98 and the piston will move in the direction of the body, opening a fluid flow path between the head 326 and the piston 330 to allow fluid in inlet 348 to flow into second inlet 52*d* and through the openings in the shuttle 310 and to outlet 54*d*.

Figure 9:
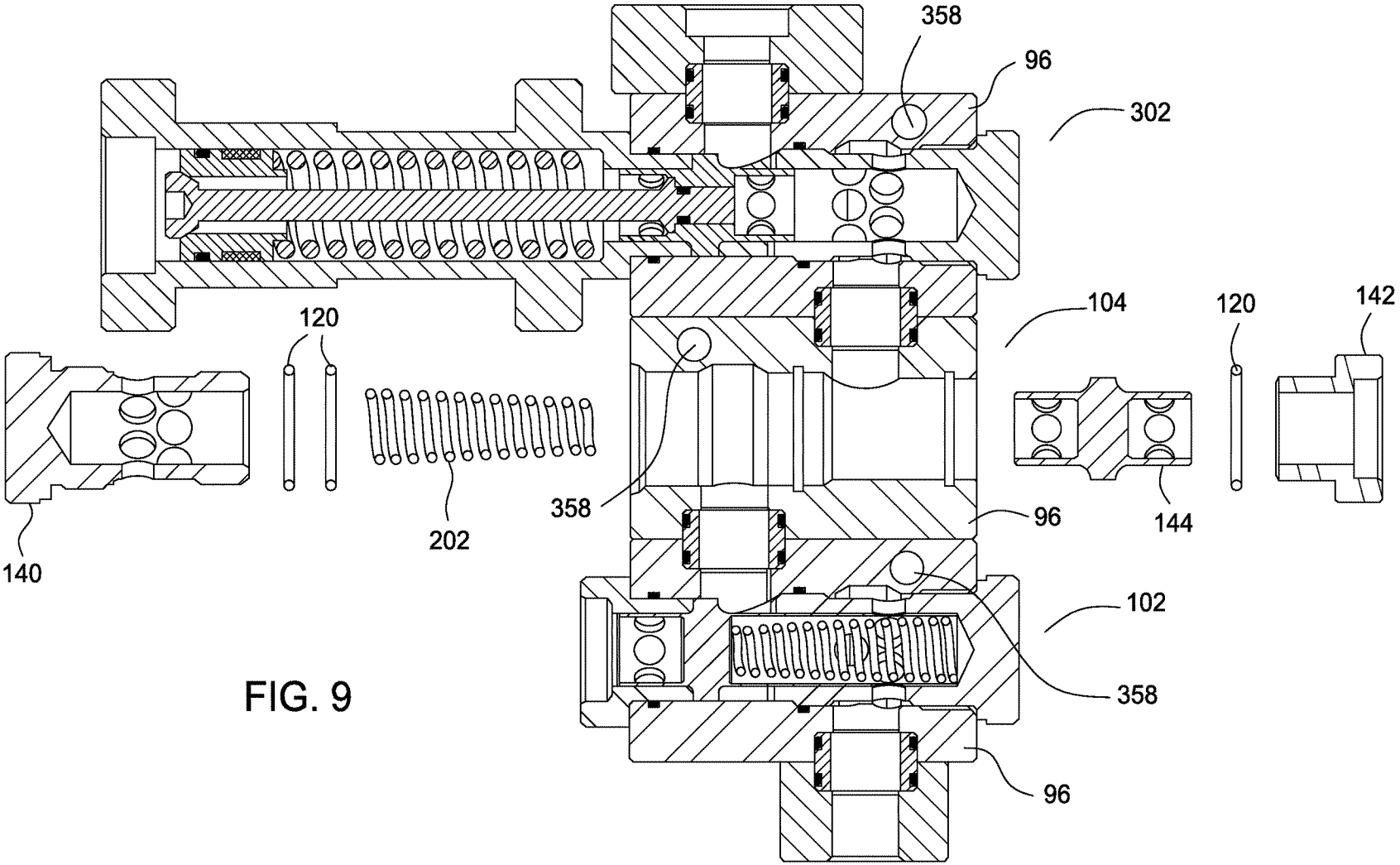
FIG. 9 is a sectional view of a shuttle valve for demonstrating the replacement or reconfiguration of the internal components thereof.

Referring now to FIG. 9, the replacement paradigm to replace the internal elements of, or reconfigure, the shuttle valves 102, 104 or 106, is shown schematically. Specifically, the cap 140 and inlet adaptor 142 are removeably threaded into the corresponding openings at the opposed ends of the counterbore 132. By removing the cap 140, the partially conical spring 202 and sealing rings for sealing 120 the cap 140 to the body 98 may be removed and replaced. Additionally, the functionality of the valve can be changed in part by replacing the partially conical spring with a spring having different spring properties. Removing the inlet adaptor 142 allows the shuttle 144 and the seal 120 for sealing the inlet adaptor 142 to the body to be replaced.

Figure 10:
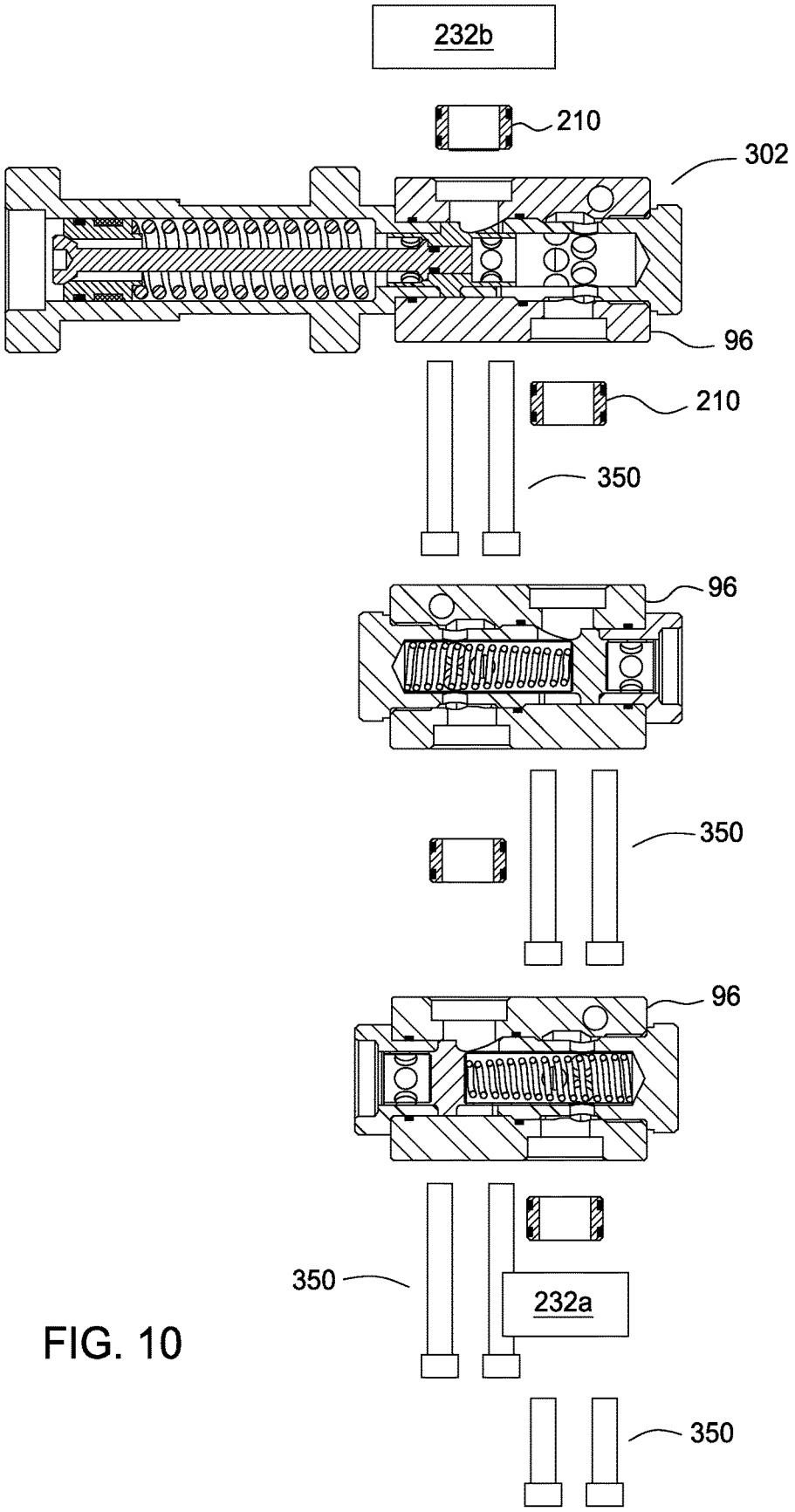
FIG. 10 is an exploded view of the shuttle valve of the second embodiment demonstrating the assembly of the stacked shuttle valve from a plurality of shuttle valve having the same body.
Figure 11:
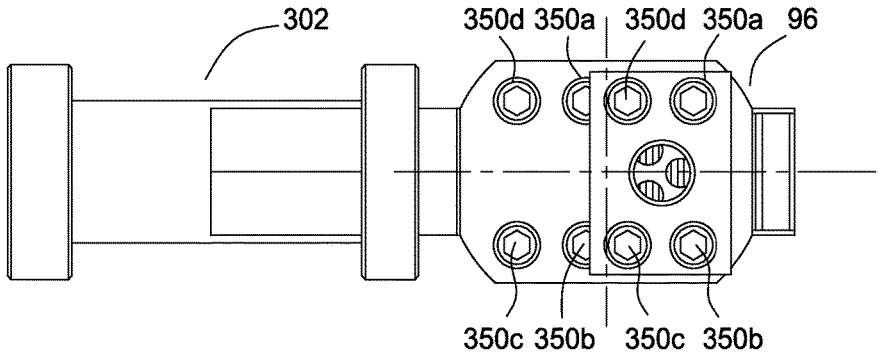
FIG. 11 is a bottom plan view of the valve of FIG. 10.
Figure 12:
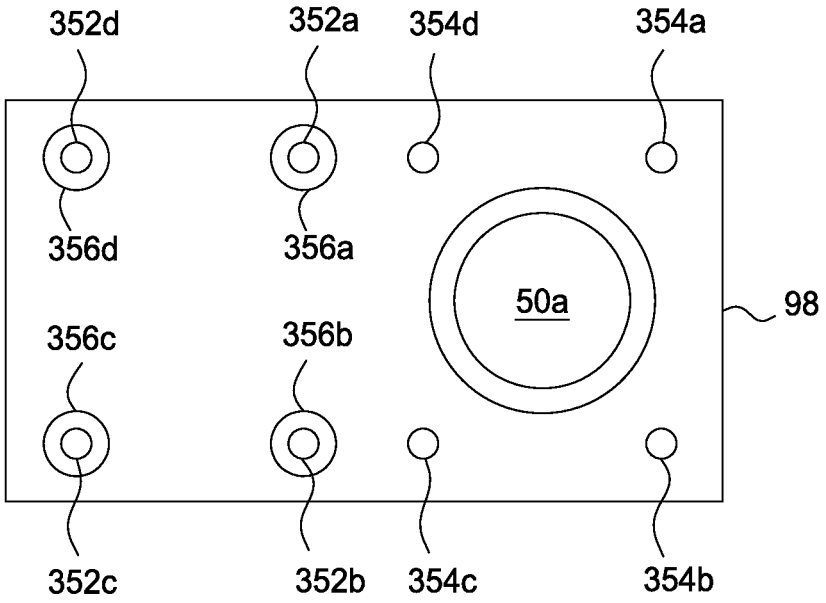
FIG. 12 is a plan view of the underside of a valve body.
Figure 13:
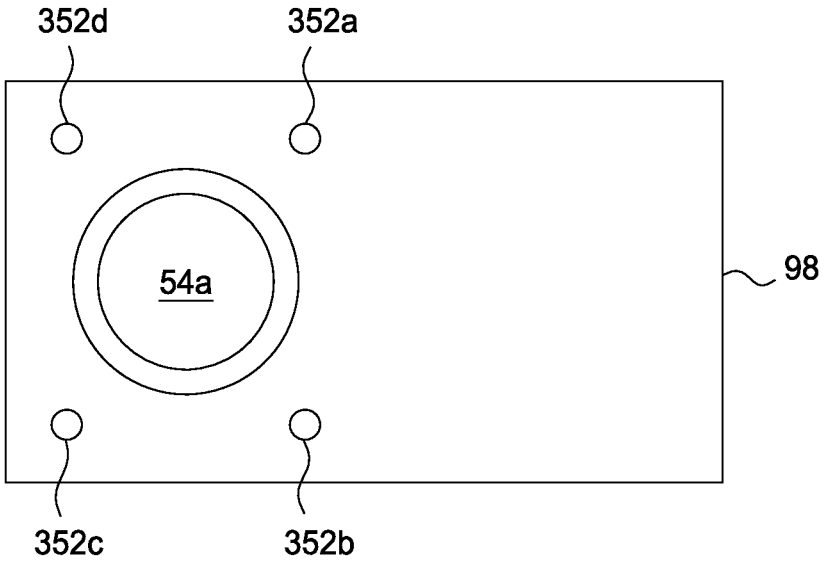
FIG. 13 is a plan view of the upper side of the valve body of FIG. 12.

Referring now to FIGS. 10 to 13, the assembly of a stacked shuttle valve 300, in the embodiment shown stacked shuttle valve 300, is demonstratively shown. FIG. 10 shows the individual shuttle valves 102, 104 and 320, and the attachment and sealing elements thereof, in an exploded view. FIG. 11 is a bottom plan view of the stacked shuttle valve 300 of FIG. 8. FIG. 12 is a bottom plan view of a body 96, and FIG. 13 is a top plan view of the body 96.

Each body 96 of a subsequent stage, for example valve 104 is subsequent to valve 102 because the outlet 54*a* of valve 102 is connected to the first inlet 5*b* of valve 104, of the stacked shuttle valve 300 is bolted to the body 98 of a previous stage utilizing a set of fasteners 350*a-d*. For example valve 104 is subsequent to valve 102 because the outlet 54*a* of valve 102 is connected to the first inlet 5*b* of valve 104 standard Code 62 seal sub. A set of clearance holes 352 having counterbores 356*a-d* at both openings thereof through the body 98 and set of threaded bolt holes 354 both in the same standard Code 62 seal sub pattern are provided in each body. The clearance holes 352*a-d* are symmetric about the center of outlet 54 of each body 96. The threaded holes 354*a-d* are symmetric about the center of first inlet 50 of each body 96. Additionally, the pattern of the holes is symmetric about the center of the lower surface of the body 98. Fasteners 550*a-d* extend through the clearance holes 352*a-d* of body 98 of valve 102 and into the threaded holes 354*a-d* of the body 98 of valve 104 with the heads thereof recessed into the counterbores 346*a-d*, with the sealing sleeve 210 extending inwardly of the larger bore of outlet 54*a* and first inlet 50*b*, to provide a sealed connection of each body of a first valve to the body 98 of a next valve. At the first inlet 50*a* and last outlet, in the case of stacked shuttle valve 300 outlet 54*d*, adaptor 232 a is secured over inlet 50*a* with a sealing sleeve 210 therebetween, and an adaptor 232*b* is secured over outlet 54*d* with a sealing sleeve 210 therebetween, using fasteners 350*a-d* in the same manner as the bodies 98 are interconnected. Thus, a stacked shuttle valve having a plurality of individual, redundant, fluid inlets may be formed. Additionally, each individual valve can be individually serviced or reconfigured in the field, and a valve such as valve 104 can be removed from the stacked shuttle valve 300 without the need to disassemble the entire stacked shuttle valve 300. Individual valves can be added or removed in the field without complete dismantling of the stacked shuttle valve 300 (or 100). Prior art stacked shuttle valves do not permit using the same body 96 at each valve stage as only one bolt pattern is used and a single set of studs is used to simultaneously attach all valve stages together.

The re-configurable stacked shuttle valves 100 and 300 use the same body 98 geometry for each valve stage. The prior art stacked shuttle valves do not permit adding or removing valve stages to an existing stacked shuttle valve because the prior art stacked shuttle valves have three different body geometries used in a single stack: 1) an inlet body geometry, 2) intermediate body(s) geometry and 3) outlet body geometry. Additionally, as shown in FIG. 9, each body 98 includes a panel mounting bore 358 extending therethrough. By extending a fastener through the panel mounting bores 359 of the bodies, the stacked shuttle valve may be readily fastened to a panel (not shown) in a subsea hydraulic assembly.

FIG. 11 illustrates the bottom view of stacked shuttle valve with body centerlines shown. The symmetrical bolt patterns allow the same bodies to be stacked. The bodies are rotated 180 degrees at the intersection of the two body centerlines in order to achieve the bolting arrangement shown in FIG. 11.

While the disclosure is susceptible to various modifications and alternative forms, specific embodiments thereof are shown by way of example in the drawings and will herein be described in detail. For example ¾", 1" and 1½" sizes are anticipated.

In another embodiment, a pressure biased shuttle valve can be re-configured by utilizing two springs and operate reliably at effectively the same flow rate as a non-biased shuttle.

Common pressure biased shuttle valves must typically operate under low flow conditions. In terms of reliability when operating at high flow rates the present invention represents a significant improvement over the existing pressure biased shuttle valves.

Pressure biased shuttle valves, such as those described in the '268 patent, were initially designed to operate at relatively small flow rates. The function of the valve described in the '268 patent is, for example, the ability to maintain the biased inlet port in the closed position and providing ingress protection against sea water that can be in contact with the biased inlet port until an ROV (Remotely Operated Vehicle) connects to the pressure biased port. New industry requirements require that flow rates produced by the intervening ROV must be equivalent to normal flow rates for BOP ram operation.

Figure 14:
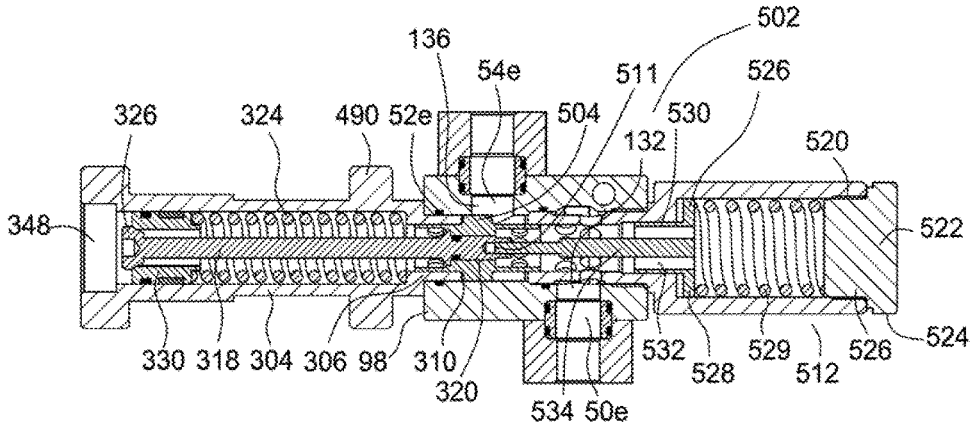
FIG. 14 is a sectional view of a re-configurable pressure and spring biased shuttle valve, showing the first inlet thereof in communication with the outlet thereof.
Figure 19:
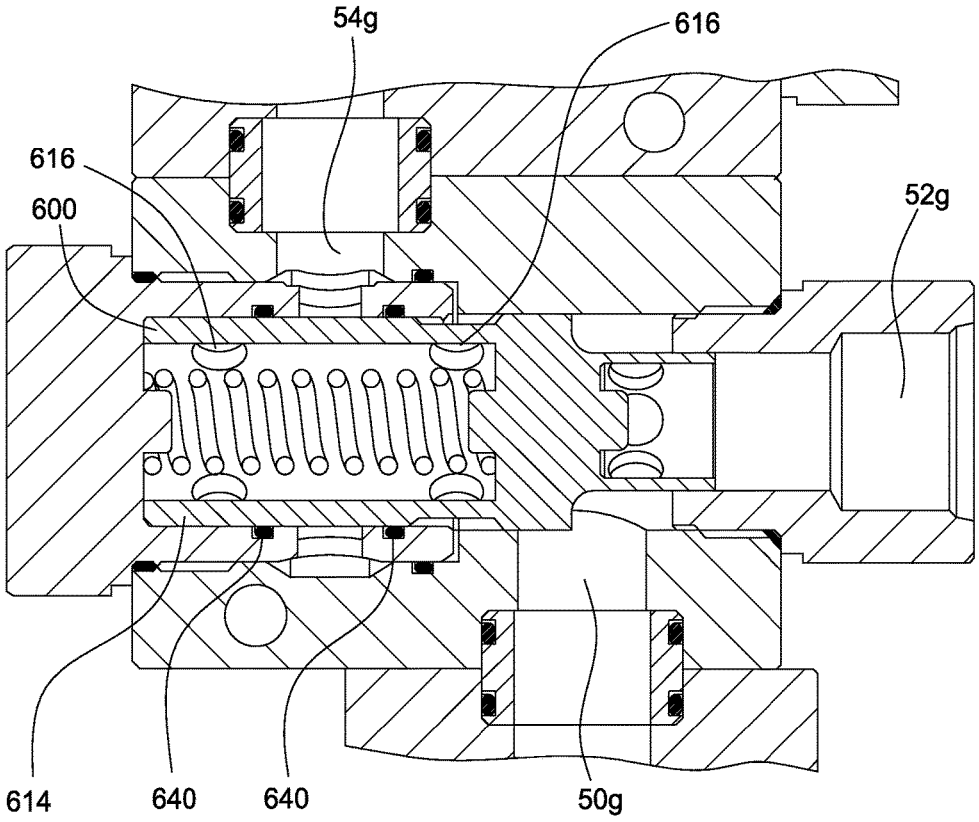
FIG. 19 is a partial sectional view of the stacked shuttle valve of FIG. 18, showing the shuttle moved away from the second inlet thereof to seal the first inlet thereof.

FIGS. 14 to 17 show a further alternative valve 502 useful on its own, or in a stacked shuttle valve 500. As with shuttle valves 102, 104, 106 and valve 302, the valve 502 preferably is incorporated into the same body 96 as that used for shuttle valves 102, 104, 106 and valve 302. Thus, valve 502 includes body 96, having a first inlet 50*e*, a second inlet 52*e*, and outlet 54*e*. Likewise, body 96 includes inlet bore 134 and outlet bore 136 intersecting with, and offset along the span of, the counterbore 132. In FIG. 14, the shuttle 504 thereof is seated against the tapered surface 308 of the reduced diameter portion 306 of housing 304, in effect closing second inlet 52*e*. Valve 502 may be used separately in a fluid line, or may replace one or more of shuttle valves 102-106 and 302 in a stacked shuttle arrangement FIG. 19 shows the valve 504 incorporated in a stacked shuttle valve in combination with shuttle valves 102 and 104.

In contrast to valves 102-106 and 302, valve 502 includes a spring and pressure biased valve assembly 506 connected to second opening and a spring biased piston assembly 508 connected to the body in the place of the cap 140. The pressure and spring biased valve assembly 506 operates in the same manner, and has the same configuration as, the pressure and spring biases valve 302, except as noted herein. The main difference between dual acting piston assemblies 330, 500, is that the first end 320 of rod 318 extends through the shuttle 504 in valve assembly 500, and includes a counterbored receptacle 510 extending inwardly of the first end 320 thereof. As with valve 302, the pressure and spring biased valve 500 includes housing 304 having an open first end forming an inlet 348 to the housing 304 and a threaded reduced diameter portion 306 which is received in second inlet 502*d* of body 98. The inner surface of the reduced diameter portion, at the end thereof, includes the tapered surface 308 to effect sealing with the radiused surface of the shuttle 504. Additionally, a pin 534 extending from the spring biased piston assembly 508 in the direction of the shuttle 504 is secured within the counterbored receptacle 510. The pin 354 is fixed to a piston 530 in the spring biased piston assembly 530. And thus the rod 318, shuttle 504, pin 534 and piston 530 all move reciprocally as a single assembly. Additionally housing 304 and body 96 show a modified construct, wherein a flange connection using a flange 490 to connect the housing 304 to the body using fasteners or a clamp are shown.

Spring biased piston assembly 508 includes a piston housing 512 composed of a generally cylindrical tube 514 having a major diameter portion 516 and a minor diameter connection nipple portion 518 which is threaded for removable receipt into the housing 98, and a cap 520 covering over an otherwise open end 520 at the end of the tube opposite to the minor diameter portion. In the embodiment shown, the cap 522 includes an enlarged outer portion 524 and a threaded inner portion 526 extending therefrom, and received within the end 520. At the nipple portion 518 end of the tube 514, a piston 526 having a major diameter portion 528 configured to provide a fluid seal with the inner surface of the major diameter portion 516 and a minor diameter portion 530 configured to provide a fluid seal with the inner surface of the nipple portion 518 is provided. The piston further includes at least one opening 532 extending therethrough through both the minor diameter portion 530 and major diameter portion 528 to enable fluid communication between the interior of the cap 522 and the crossbore 132 of the valve body 96. And an actuating pin 534 extending from the piston 526 and received in the a counterbored receptacle 510 in the first end 320 of rod 318. A second coil spring 529 is positioned between the cap 520 and the major diameter portion 528 of the piston 526, and provides a force tending to bias the pin 534 in the direction of the second opening 52*e* of the body 98.

In the position of the valve assembly 500 shown in FIG. 14, first inlet 50*e* is used for normal operation as it is maintained in the open position by the balance of force produced by the spring 354 and the second coil spring 529 and any pressure at inlet 50*e* on the shuttle 510.

Figure 15:
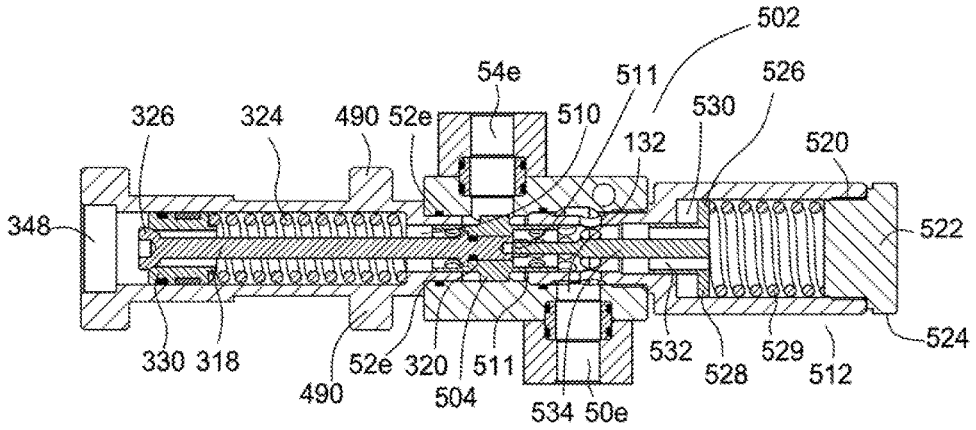
FIG. 15 is a sectional view of the a re-configurable pressure and spring biased shuttle valve of FIG. 14 showing the shuttle thereof moving away from the second inlet thereof.

FIG. 15 shows the shuttle 510 moving towards the first inlet 50*e* due to pressure being applied to inlet 348, with zero absolute pressure applied to Inlet 50*e*. In FIG. 12, first inlet 50*e* is being closed while second inlet 52*e* is being opened. As this is occurring, only the first spring 324 force is acting against the piston 330 movement.

Figure 16:
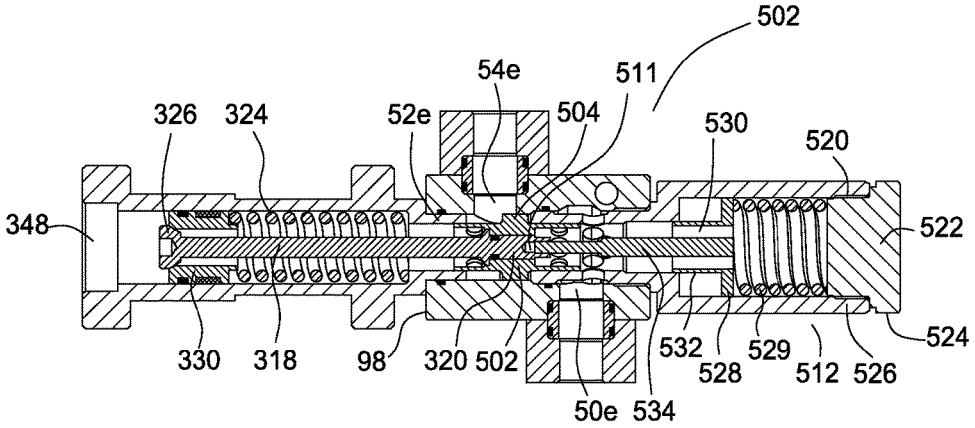
FIG. 16 is a sectional view of the a re-configurable pressure and spring biased shuttle valve of FIG. 14 showing the shuttle thereof sealing off the first inlet thereof.

In FIG. 16, the shuttle 510 contacts the seat formed by the end of the nipple portion adjacent to first inlet 50*e* due to increased pressure being applied to inlet 348, with zero absolute pressure applied to first inlet 50*e*. First inlet 50*e* is thus closed while second inlet 52*e* is not yet opened. Only the second coil spring 529 force is acting against the movement of the piston 526 inwardly of the tube. The force produced by the first spring 324 is not large enough to disengage the shuttle from the opposite seat, and second coil spring 529 is fully compressed and the shuttle 510 has moved to its greatest extent to seal inwardly of the piston housing 512.

Figure 17:
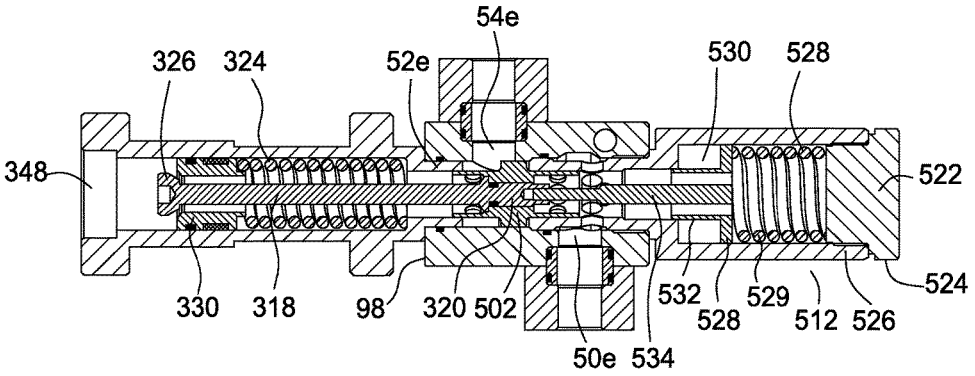
FIG. 17 is a sectional view of the a re-configurable pressure and spring biased shuttle valve of FIG. 14 showing the shuttle thereof sealing off the first inlet thereof and a piston configured to communicate fluid through the second inlet to the outlet.

FIG. 17 shows the piston 330 in the cracked open position due to yet a further increase in pressure being applied to inlet 52*e*, with absolute zero pressure applied to inlet 50*e*, causing the piston 330 to move in the direction of second inlet 52*e* while rod 318, and thus the head 326, are prevented from further movement inwardly of the body 96 by complete compression of the second coil spring 529. Inlet 52*e* is thus opened and inlet 50*e* remains is closed. Only the force produced by the second coil spring 529 is acting on the shuttle. The force produced by the second coil spring is not large enough to disengage the shuttle from the seat so inlet 50*e* remains closed. Only the force produced by the first spring 324 is acting on the piston 330. Thus, the force produced by the first spring 325 determines the absolute pressure at which the piston 330 cracks open. If the pressure at inlet 348 exceeds the absolute pressure at which the piston 330 cracks open, the piston 330 will move in the direction of the inlet 50*e*, but pin 318 cannot move further inwardly of body 98 and thus piston 330 separates from head 326 of pin 318 allowing fluid flow from inlet 348, through the bore 332 in piston 330, through second inlet 54*e*, through flow guide 190 openings 194 and to outlet 54*e*. By varying the first and second coil spring forces and spring rates the functional characteristics of the re-configurable pressure and spring biased shuttle valve can be adjusted to suit specific installation requirements. The dual acting piston assembly 506 can also be used without the without spring biased piston assembly 508, where the spring biased piston assembly 508 is replaced with the inlet adaptor 142 of valves 102, 104 and 106.

Figure 18:
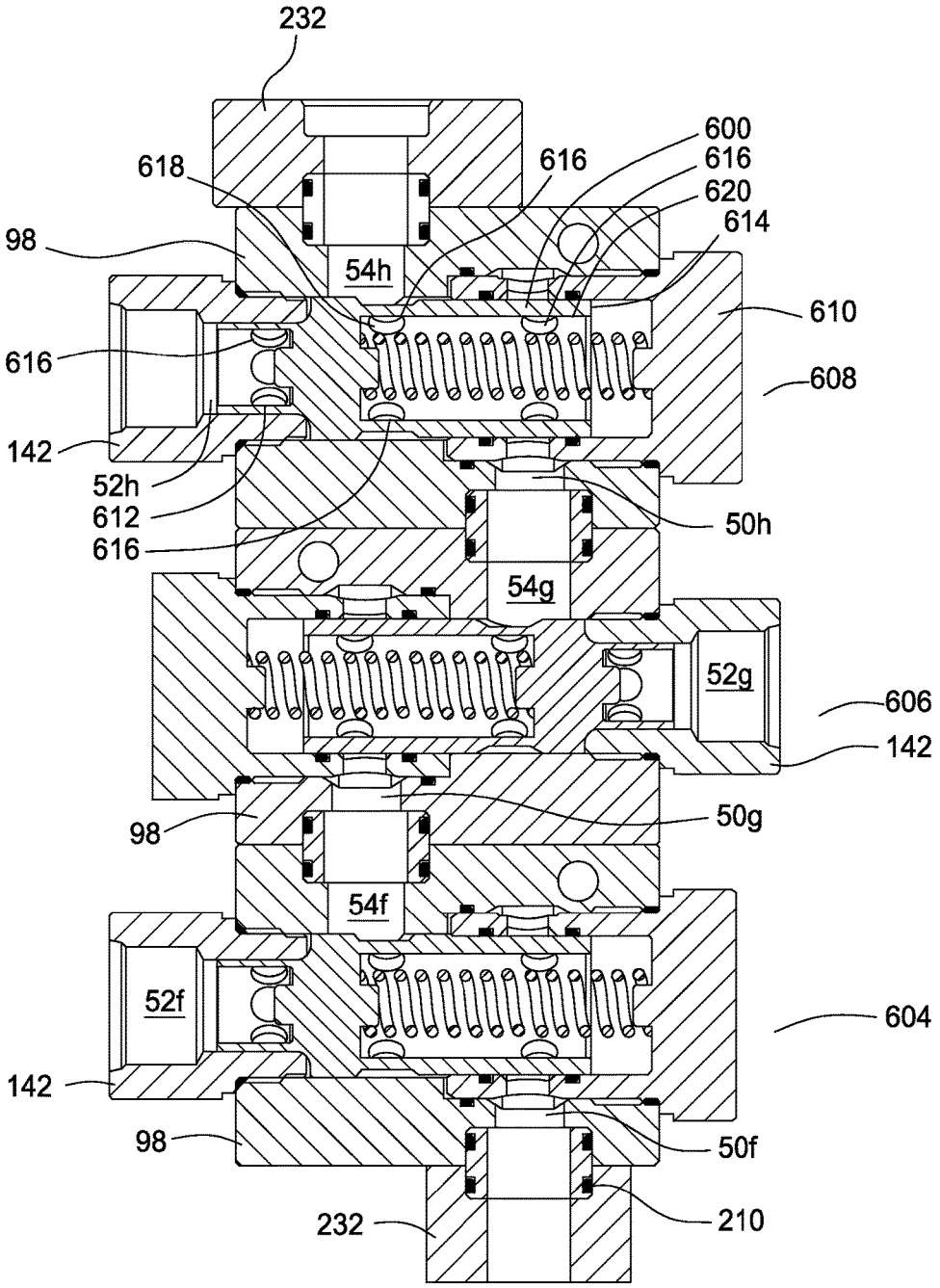
FIG. 18 is a sectional view of another embodiment of a stacked shuttle valve.

FIGS. 18 to 20 show another embodiment of a stacked shuttle valve, wherein a modified elongated shuttle is used in place of the shuttle 144 of the first embodiment hereof to form an elongated shuttle stacked shuttle valve 602.

Each valve 604-608 includes housing 98 having the same construct as that of valves 102-106, inlet adaptor 142, first inlets 50*f*-50*h*, second inlets 52*f*-52*h* and outlets 54*f*-54*h*. As with the first embodiment hereof, outlet 54*f* of valve 604 is fluidly connected to first inlet 50*g* of valve 606, and outlet 54*g* of valve 606 is connected to first inlet 50*h* of valve 608. The elongated stacked shuttle valve 602 is assembled in the same manner as that described herein with respect to FIGS. 10 to 13 for the stacked shuttle valve 300, and thus sealing sleeves 210 are provided between each adjacent valve connection, and adaptors 232 are connected with an intervening sealing sleeve 210 to inlet 50*f* of the valve 604 and the outlet 54*h* of the valve 608. Fasteners connect the adaptor 232 to the valve 604. And connect valve 604 to valve 606, valve 606 to valve 608, and valve 608 to adaptor 232.

The elongated stacked shuttle valve 602 is configured to simultaneously pressurize multiple inlets with supply pressure in certain emergency situations, versus supplying only one inlet with supply pressure as is contemplated with respect to the other embodiments herein. When the emergency situation occurs, pressurized fluid will arrive at first inlet 50*f* or one of the second inlets 52*f-h* ahead of all the other inlets, and must then flow to the upper outlet of the stack. This occurs because the pressure feeding sources, the piping from the sources, and the valving and switching will result in one inlet receiving fluid pressure and flow before the others. In this operating scenario, due to system design variables, it is impossible to predict which inlet will first receive pressurized fluid. Depending on which inlet is pressurized first, system fluid may or may not need to subsequently flow across additional valves to reach the outlet 54*h*.

To achieve this functionality when the biased elongated shuttle 600 of the first valve 604 shifts to open the first inlet 50*f* thereof, all of the remaining inlets 52*f-h* must be prevented from opening and/or communicating with the outlet. In affect the functionality of all biased elongated shuttles 600 except for the first one to shift, must be overridden.

As shown in FIG. 18, the biased elongated shuttle 600 is, in contrast to shuttle 144 described previously herein, asymmetric, Flow guide 612 on the side of the shuttle facing the inlet adaptor has generally the same configuration as that of flow guides 188, 190 of shuttle 144. However, flow guide 614 on the opposite side of the shuttle 600 which extends inwardly of, and is supported by, the elongate shuttle cap 610 is significantly longer than, has a different flow passage 616 pattern than, and a larger internal diameter as compared to, flow guide 612. The flow passages 616 on flow guide 612 have the same pattern and sizes as openings 194 in flow guide 190, whereas two sets of flow passages 616, are arranged about the circumference of flow guide 614 adjacent the inner and outer ends 618, 620 thereof. When pressurized fluid flows to the outlet 54 of one of the valves through the spaced flow ports provided in the flow guide 614, pressure acting on the base 622 of the flow guide 614, which has a larger area than the base 624 of flow guide 612, produces a seating force required to maintain the flow guide 612 side of the shuttle 600 in sealing contact with end of the inlet adaptor 142 and thus maintain the second opening 52 in the closed position. A compression spring installed in the elongated the flow guide 614 contributes to maintaining the second inlet 52 in the closed position. With the second inlet 52 in the closed position the flow passage to the outlet 54, which goes into and out of the flow guide 614 through the spaced flow passages 616, is maintained.

FIG. 19 illustrates how the flow guide 614 shut off flow from all other inlets to the stacked shuttle valve 602 when any elongated bias shuttle 600 upstream therefrom shifts first:

1) downstream shuttles remain in the closed position due to the above mentioned annular seating force.

2) upstream stacked shuttles can shift due to supply pressure subsequently reaching an inlet thereof, however the upstream flow passage comprising the inlet to the downstream valve that has already shifted is closed, as shown in FIG. 19, where the flow passages of the flow guide 614 are sealed from communication with the first inlet 50*g* by the movement of the elongated bias shuttle 600 to locate the flow passages 616 through the flow guide 614 to either side of the inlet first inlet 50*g*, and o-ring seals 640 in the inner surface of the bore of the cap 610 seal with the outer surface of the flow guide 614 in locations between the flow passages 616 and the inlet 50*g*.

As a result of the architecture of the valve 602, only fluid at the inlet of the valve 604, 606 or 608 in which the shuttle 600 shifts first will flow through to the outlet 54*g*.

In each of the embodiments hereof, a common body 98 is provided to form multiple stages of a stacked shuttle valve, including configurations where all of the valves in the stacked shuttle valve have the same construct, and other configurations where despite having common bodies, the valves have different constructs, such as a combination of shuttle valves and at least one valve which, although including a shuttle therein, is configured for remote operation by being accessed by a remotely operated vehicle.

In addition, although the body 98 has been described in terms of both threaded connections of components thereto, and bolted connection of each body to the next adjacent body, the body 98 may be modified such that the components such as cap 140, rather than being connected through a threaded connection, is connected to the body by a flange surrounding the cap, and the flange is connected to the body by bolting or clamping the flange thereto. Additional connections, such as bayonet style connections may also be employed. Additionally, the individual components received in the inlets to the body may also have threaded inlets, stab type connections, flange type connections where an external component such as a fluid line is attached thereto by connecting a flange to the component or the body, or other connections where a leak tight seal can be formed.

While some embodiments of the invention have been described separately, any and all can be used together. For example, features of the stacked shuttle valve can be used with features of the re-configurable pressure and spring biased shuttle valve. And those combinations are anticipated in the scope of this disclosure.

While the disclosure is susceptible to various modifications and alternative forms, specific embodiments thereof are shown by way of example in the drawings and will herein be described in detail. For example ¾", 1" and 1½" sizes are anticipated.

It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

I claim:

1. A stacked shuttle valve, comprising:

at least a first stage and a second stage, each of the first and second stages including an interchangeable body having a first inlet, a second inlet, and an outlet, a cross bore extending through the interchangeable body generally normal to the first inlet and the outlet, and an interchangeable shuttle therein, a cap, having a sleeve body including a first bore therein, the sleeve body extending inwardly of the cross bore at a first end thereof, the sleeve body including a plurality of openings extending from the exterior thereof to the first bore, the openings in fluid communication with the first inlet;

an inlet adaptor including a nipple extending inwardly of the cross bore at a second end thereof, opposed to the first end of the cross bore, the nipple including a second bore therein, the cap and inlet adaptor spaced apart from each other across a portion of the cross bore;

wherein the shuttle comprises an annular portion having an outer cylindrical wall configured to be received in, and slidable with respect to, the cross bore, and opposed first and second flow guides extending therefrom, the first flow guide at least partially extending inwardly of the first bore and the second flow guide at least partially extending inwardly of the second bore, and at least one flow guide including an annular wall surrounding a first flow guide bore and a plurality of passages extending through the annular wall and opening at the first flow guide bore; and the outlet of at least one body is connected to the first inlet of a second body, and the first and second bodies are severably interconnected.

2. The stacked shuttle valve of claim 1, wherein the cap and the inlet adaptor further comprise seat components, and the cap and the inlet adaptor configured for removal from the interchangeable body without separating the interchangeable bodies from each other.

3. The stacked shuttle valve of claim 1, the second of the flow guide including an annular wall surrounding a second flow guide bore and a plurality of passages extending through the annular wall and opening at the second flow guide bore.

4. The stacked shuttle valve of claim 1, further comprising a biasing element extending between the cap and the first flow guide bore, the biasing element configured to push the shuttle away from the cap.

5. The stacked shuttle valve of claim 4, wherein, at the furthest extension of the shuttle from the cap, the first flow guide partially extends inwardly of the first bore.

6. The stacked shuttle of claim 1, wherein the shuttle is symmetric about a plane extending through the annular portion thereof.

7. The stacked shuttle valve of claim 1, further comprising a pressure and spring biased valve connected to the outlet of the second stage.

8. The stacked shuttle valve of claim 7, wherein the pressure and spring biased valve includes a body interchangeable with that of the first and second stages.

9. The stacked shuttle valve of claim 1, further comprising a conical coil spring extending between the shuttle and one of the inlet adaptor and cap.

10. A stacked shuttle valve, comprising:

at least a first stage and a second stage, each of the first and second stages including an interchangeable body having a first inlet, a second inlet, and an outlet, a cross bore extending through the interchangeable body generally normal to the first inlet and the outlet, and an interchangeable shuttle therein, a cap, having a sleeve body including a first bore therein, the sleeve body extending inwardly of the cross bore at a first end thereof, the sleeve body including a plurality of openings extending from the exterior thereof to the first bore, the openings in fluid communication with the first inlet;

an inlet adaptor including a nipple extending inwardly of the cross bore at a second end thereof, opposed to the first end of the cross bore, the nipple including a second bore therein, the cap and inlet adaptor spaced apart from each other across a portion of the cross bore;

wherein the shuttle comprises an annular portion having an outer cylindrical wall configured to be received in, and slidable with respect to, the cross bore, and opposed first and second flow guides extending therefrom, and an annular wall extending between the first and second flow guides and the outer cylindrical wall, wherein the connection of the annular wall extending between the first and second flow guides and the outer cylindrical wall is radiused, and the outlet of at least one body is connected to the first inlet of a second body, and the first and second bodies are severably interconnected.

11. The stacked shuttle valve of claim 10, wherein the cap and the inlet adaptor further comprise removeable seat components in each body, and the cap and the inlet adaptor are configured for removal from the interchangeable body without separating the interchangeable bodies from each other.

12. The stacked shuttle valve of claim 10, wherein the first and second flow guides each include an annular wall surrounding a flow guide bore and a plurality of passages extending through the annular wall and opening at the flow guide bore.

13. The stacked shuttle valve of claim 12, further comprising a biasing element extending between the cap and a flow guide bore, the biasing element configured to push the shuttle away from the cap.

14. The stacked shuttle valve of claim 13, wherein, at the furthest extension of the shuttle from the cap, the first flow guide partially extends inwardly of the first bore.

15. The stacked shuttle of claim 12, wherein the shuttle is symmetric about a plane extending through the annular portion thereof.

16. The stacked shuttle valve of claim 10, further comprising a pressure and spring biased valve connected to the outlet of the second stage.

17. The stacked shuttle valve of claim 16, wherein the pressure and spring biased valve includes a body interchangeable with that of the first and second stages.

* * * * *